US006358133B1

(12) United States Patent
Cesena et al.

(10) Patent No.: US 6,358,133 B1
(45) Date of Patent: Mar. 19, 2002

(54) GRINDING WHEEL

(75) Inventors: Robert T. Cesena, Richfield, MN (US); Naum N. Tselesin, Atlanta, GA (US); Gary M. Palmgren, Lake Elmo; Jay B. Preston, Woodbury, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/256,837

(22) Filed: Feb. 24, 1999

Related U.S. Application Data

(63) Continuation-in-part of application No. 09/019,657, filed on Feb. 6, 1998.

(51) Int. Cl.[7] ..... B24B 55/02

(52) U.S. Cl. ..... 451/450; 451/541; 451/542; 451/544; 451/546; 451/547

(58) Field of Search ..... 451/541, 542, 451/544, 546, 547

(56) References Cited

U.S. PATENT DOCUMENTS

| | | | | |
|---|---|---|---|---|
| 3,127,715 A | | 4/1964 | Christense | |
| 3,324,603 A | * | 6/1967 | Niemiec | 451/542 |
| 3,576,090 A | * | 4/1971 | Shoemaker | 451/548 |
| 3,906,684 A | * | 9/1975 | Marshall et al. | 51/295 |
| 4,131,436 A | | 12/1978 | Wiand | |
| 4,208,843 A | | 6/1980 | Amaki et al. | |
| 4,275,528 A | | 6/1981 | Higginbotham | |
| 4,637,173 A | | 1/1987 | Hundebol | |
| 4,826,509 A | | 5/1989 | Schwämmle | |
| 4,925,457 A | | 5/1990 | deKok et al. | |
| 4,949,511 A | * | 8/1990 | Endo et al. | 51/295 |
| 4,961,807 A | | 10/1990 | Ichiguchi | |
| 4,977,709 A | | 12/1990 | Siden | |
| 5,049,165 A | | 9/1991 | Tselesin | |
| 5,092,910 A | | 3/1992 | deKok et al.jf124c | |

FOREIGN PATENT DOCUMENTS

| | | |
|---|---|---|
| DE | 35 03 619 C2 | 8/1994 |
| EP | 0 086 086 | 2/1982 |
| JP | 3-161278 | 7/1991 |
| JP | 3-190673 | 8/1991 |
| JP | 9-19869 | 1/1997 |
| WO | WO 98/30359 | 7/1998 |

OTHER PUBLICATIONS

3M Roll Grinding, Superfinishing and Microfinishing Systems brochure, 11 pages, 1996.
3M Roloc™ Flexible Diamond Discs brochure, 1 page.
3M Flexible Diamond Products For Industrial Markets brochure, 22 pages, 1997.
Load–bearing formulations for metals, rubber, glass and more; 1 page.

*Primary Examiner*—Joseph J. Hail, III
*Assistant Examiner*—Shantese McDonald
(74) *Attorney, Agent, or Firm*—Scott R. Pribnow

(57) ABSTRACT

A cylindrical, abrasive grinding wheel having a cylindrical abrasive region with an abrasive surface at an outer circular band thereof. The abrasive region includes layers of abrasive particles. The layers of abrasive particles can be tilted with respect to an axis of rotation of the grinding wheel or they can such that grooving in the grinding wheel and a workpiece ground by the grinding wheel can be reduced. Alternatively, the abrasive region can be formed from a plurality of abrasive segments each having layers of abrasive particles. The layers of abrasive particles can be staggered in the direction of the axis of rotation from one segment to another. This can also reduce grooving in the grinding wheel and workpieces.

36 Claims, 12 Drawing Sheets

U.S. PATENT DOCUMENTS

| | | | | |
|---|---|---|---|---|
| 5,127,197 | A | | 7/1992 | Brukvoort et al. |
| 5,143,523 | A | | 9/1992 | Matarrese |
| 5,190,568 | A | | 3/1993 | Tselesin |
| 5,197,249 | A | | 3/1993 | Wiand |
| 5,203,880 | A | | 4/1993 | Tselesin |
| 5,251,408 | A | * | 10/1993 | Boaz ..... 451/450 |
| 5,380,390 | A | | 1/1995 | Tselesin |
| 5,385,591 | A | | 1/1995 | Ramanath et al. |
| 5,423,717 | A | | 6/1995 | Boaz |
| B14,925,457 | | | 9/1995 | deKok et al. |
| B15,049,165 | | | 9/1995 | Tselesin |
| B15,092,910 | | | 9/1995 | deKok et al. |
| B15,203,880 | | | 10/1995 | Tselesin |
| 5,486,131 | A | | 1/1996 | Cesna et al. |
| 5,489,235 | A | | 2/1996 | Gagliardi et al. |
| B15,190,568 | | | 3/1996 | Tselesin |
| 5,518,443 | A | | 5/1996 | Fisher |
| B15,380,390 | | | 10/1996 | Tselesin |
| 5,620,489 | A | | 4/1997 | Tselesin |
| 5,645,633 | A | | 7/1997 | Ogawa |
| 5,656,045 | A | | 8/1997 | Wiand |
| 5,842,912 | A | | 12/1998 | Holzapfel et al. |

* cited by examiner

GRINDING WHEEL

This application is a continuation-in-part of pending prior application Ser. No. 09/019,657, filed on Feb. 6, 1998.

TECHNICAL FIELD

The present invention relates generally to abrasive or superabrasive tools. In particular, the present invention relates to a rotatable grinding wheel having an abrasive or superabrasive surface.

BACKGROUND OF THE INVENTION

Certain types of workpieces (plastic and glass lenses, stone, concrete, and ceramic, for example) can be advantageously shaped using grinding tools, such as a wheel or disc, which have an abrasive work surface, particularly a superabrasive work surface, a superabrasive surface also being an abrasive surface but having a higher abrasivity. The work surface of the grinding tool can be made up of an abrasive band around the outer circumference of the wheel or disk. The work surface usually includes particles of super hard or abrasive material, such as diamond, cubic boron nitride, or boron suboxide surrounded by a bond material and/or embedded in a metal matrix. It is these abrasive particles that primarily act to cut or grind a workpiece as it is brought into contact with a rotating work surface of the grinding tool.

It is known to form cutting or grinding wheels comprising segments of abrasive material. The abrasive segments can be formed by mixing abrasive particles such as diamonds and metallic powder and/or other filler or bond material in a mold and pressure molding the mixture at an elevated temperature. Forming abrasive segments in this way, however, can create areas having high concentrations of hard or abrasive particles and areas having low concentrations of abrasive particles in the segment. Further, the concentration of abrasive particles at an abrasive surface affects grinding characteristics of the wheel such as wheel wear rate and grinding rate. As such, non-uniform or randomly varying concentrations of abrasive particles can cause unstable cutting or grinding performance. Also, forming abrasive segments in this way can be relatively expensive because a relatively high number of abrasive particles are used.

To reduce problems associated with non-uniform or randomly varying concentrations of abrasive particles in abrasive surfaces, it is known to form abrasive segments in which concentrations of abrasive particles vary in an orderly manner. For example, abrasive segments can be formed having substantially parallel, planar layers of abrasive particles separated by regions of bond material. Abrasive material having such layers of abrasive particles are disclosed in, for example, U.S. Pat. No. 5,620,489, issued on Apr. 15, 1997 to Tselesin, entitled Method for Making Powder Preform and Abrasive Articles Made Therefrom; U.S. Pat. No. 5,049,165, issued Sep. 17, 1991 to Tselesin entitled Composite Material; and Japanese Laid Open Patent Publication J.P. Hei. 3-161278 by Tanno Yoshiyuki, published Jul. 11, 1991 for Diamond Saw Blade ("Yoshiyuki").

Yoshiyuki discloses a saw blade for cutting stone, concrete, and/or fire resistant material. The saw blade is formed from abrasive segments having planar layers of abrasive particles. The layers of abrasive particles are aligned with a direction of rotation of the saw blade such that the cut in a workpiece forms grooves, as can be seen in FIG. 3 of Yoshiyuki. Such grooves are formed because the areas of bond material between planes of abrasive particles wear faster than the areas of the planes of abrasive particles.

However, for some applications of a grinding tool, wear grooves are undesirable or unacceptable. In some cases, it is specifically desirable to be able to produce a smooth, rounded edge on a workpiece. For example, a type of grinding wheel, known as a pencil wheel, is generally used to grind the edges of panes of glass to remove sharp edges of the glass and leave rounded edges free of cracks that could cause the glass to break. The production of grooves in the rounded edge would be undesirable.

In addition to the foregoing, an improvement over the generally practiced methods of assembling grinding wheels is desired. Typically, assembly of a grinding wheel includes either a brazing or a sintering process in order to bond the abrasive material to the support plate(s). These processes may be disfavored for a number of reasons. For example, brazing an abrasive layer to an aluminum support plate (a preferred material due to its light weight) may be difficult to accomplish due to the presence of aluminum oxide on the surface of the support plate which inhibits wetting-out of the braze material. Sintering is generally disfavored due to the long time period and high temperature required. Furthermore, both sintering and brazing are incompatible with non-metallic (e.g., polymeric) support plates. In view of these disadvantages, an improved method of bonding the abrasive layer to the support plate(s) in a grinding wheel is desired.

SUMMARY OF THE INVENTION

In accordance with the present invention, a grinding wheel exhibits an abrasive surface having an ordered concentration of abrasive particles to advantageously produce stable grinding results. But also, the abrasive surface of the wheel is able to produce a smooth edge on a workpiece. In some instances, the edge produced on a workpiece may also be rounded.

The present invention includes a generally cylindrical abrasive grinding wheel which is rotatable about an axis of rotation. A substantially cylindrical region of abrasive material having an abrasive surface on an outer peripheral surface thereof is formed from a plurality of layers of abrasive particles. Each layer of abrasive particles extends in at least a circumferential direction and a radial direction of the cylindrical region of abrasive material. By extending the layers in a radial direction, as an edge of an abrasive particle layer is worn away by use of the wheel, a fresh edge will advantageously be exposed. When a wheel having a shaped or profiled edge is used, however, the edge may have to be re-profiled as it is worn down.

One aspect of the invention is characterized by the layers of abrasive particles being arranged on the abrasive surface such that any circular path defined by an intersection of a plane perpendicular to the axis of rotation of the grinding wheel and a complete circumference of the abrasive surface will intersect at least one of the plurality of layers of abrasive particles.

Another aspect of the invention can be characterized by the layers of abrasive particles being tilted with respect to the axis of rotation of the grinding wheel to form an angle of between 0 degrees and 180 degrees, exclusive, therewith. In this way, as the grinding wheel is rotated through a 360 degree rotation, an exposed edge of a single abrasive particle layer will sweep over an axial distance wider than the width of the exposed edge of the abrasive particle layer. If the layers of abrasive particles are tilted with respect to the axis of rotation such that the width of the axial distances over which each abrasive particle layer sweeps meet or overlap, then grooving on the surface of a workpiece can be reduced and preferably eliminated.

Yet another aspect of the invention can be characterized by the grinding wheel being formed from a plurality of abrasive segments each including layers of abrasive particles. The layers of abrasive particles are staggered in an axial direction from one segment to another. In this way, the exposed edges of the abrasive particle layers will sweep across a greater portion of an axial thickness of the abrasive surface. This can also reduce grooving on a workpiece. In some embodiments, it may be feasible to reduce grooving with segments whose abrasive particles are not in layers but are randomly spaced.

Yet another aspect of the invention can be characterized by the grinding wheel including a layer of metal bond abrasive which is adhesively bonded to at least one support plate. As used herein the term "adhesive" refers to a polymeric organic material capable of holding solid materials together by means of surface attachment. As used herein the term "metal bond abrasive" refers to an abrasive material comprising a plurality of abrasive particles distributed throughout a metal bond material. The abrasive particles may be randomly distributed (i.e., non-uniform or randomly varying concentrations) throughout the metal bond material or the concentration of abrasive particles may vary in an orderly manner (e.g., substantially parallel, planar layers of abrasive particles separated by regions of metal bond material). The layer of metal bond abrasive may comprise a single mass or more than one mass. In a preferred embodiment, a plurality of discrete metal bond abrasive segments are circumferrentially spaced between two support plates and are adhesively bonded to the support plates by a structural adhesive which is interposed between the abrasive segments and the support plates.

DETAILED DESCRIPTION

Figure 1:
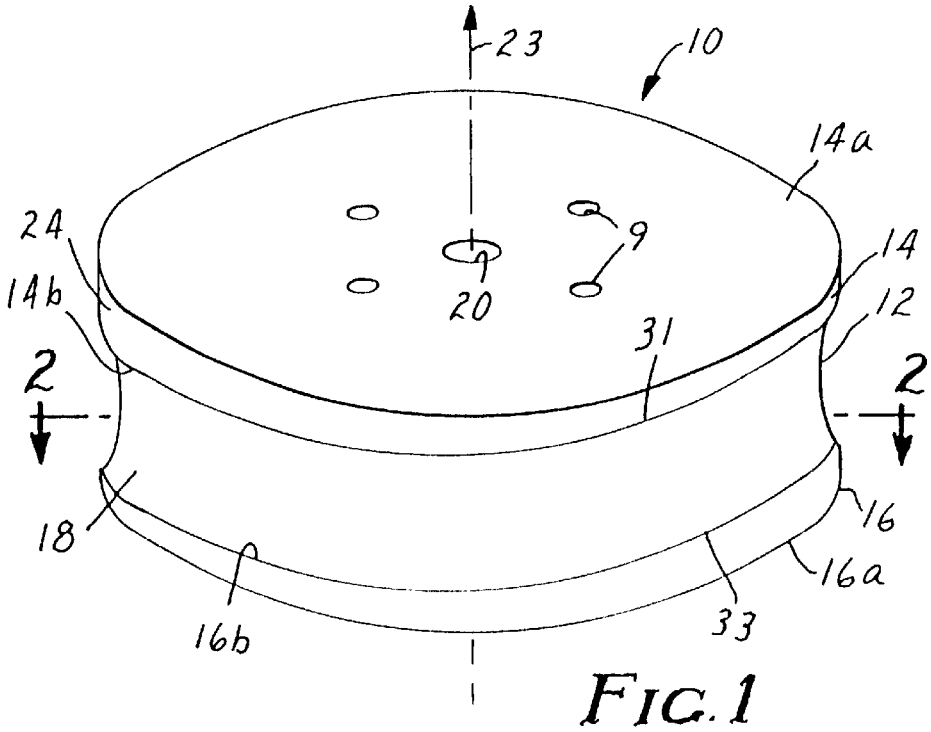
FIG. 1 is a perspective view of an abrasive grinding wheel having a tilted abrasive surface in accordance with the present invention.

FIG. 1 is a perspective view of cutting or grinding wheel 10 having an abrasive perimeter surface in accordance with the present invention. Wheel 10 is substantially cylindrical in shape and includes an abrasive region 12 preferably sandwiched between a first support plate 14 and a second support plate 16. An outer abrasive surface 18 of abrasive region 12 is a substantially cylindrical band which extends about a portion of the circumferential surface 24 of wheel 10. Wheel 10 includes a bore 20 in the center thereof which passes entirely though wheel 10. Bore 20 is to allow wheel 10 to be mounted to a rotatable shaft (not shown) for rotating wheel 10 thereabout. Accordingly, a rotatable shaft placed through bore 20 would extend along the axis of rotation 23 of wheel 10. Alternatively, the axis of rotation can be defined by longitudinally aligned shaft portions fixed within plates 14 and 16. It is also contemplated to attach wheel 10 to a rotatable shaft by attaching a substantially circular mounting plate (not shown) having a central shaft (not shown) to wheel via mounting holes 9. It is to be understood, however, that mounting holes 9 are not necessary. By rotating wheel 10 on or by a rotatable shaft, a workpiece can be held against the circumferential surface 24 of wheel 10 to be abraded by abrasive surface 18 so that the workpiece can be appropriately shaped, ground, or cut.

Figure 3:
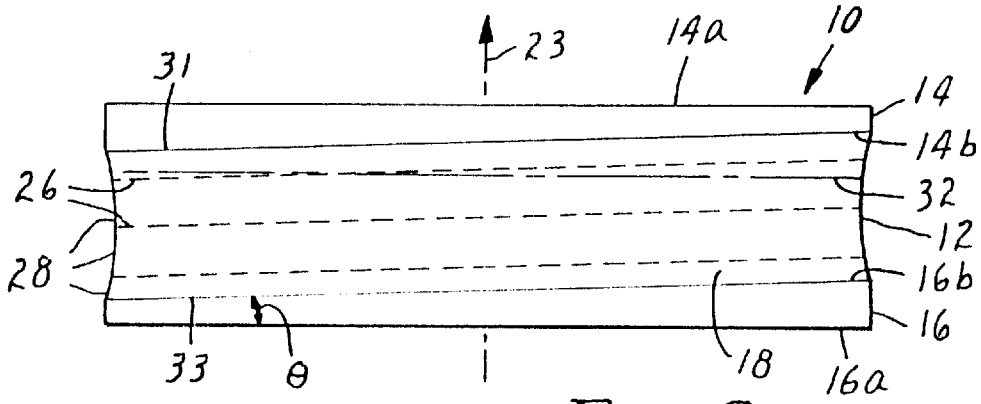
FIG. 3 is a front view of the grinding wheel shown in FIG. 1 illustrating layers of abrasive particles in an abrasive region thereof.

Support plates 14 and 16 are substantially rigid and preferably formed of steel, but could also be bronze, aluminum, or any other suitably rigid material. Support plates 14 and 16 can be formed from unsintered or sintered powder material. At least one of these plates can comprise no abrasive particles or can comprise some abrasive particles of lesser concentration and/or size than abrasive region 12. Plates 14 and 16 have outer surfaces 14*a* and 16*a* respectively which are preferably perpendicular to the axis of rotation 23 of disk 10. Plates 14 and 16 also have inner surfaces 14*b* and 16*b* respectively. As shown in FIG. 3, which is a front view of wheel 10, inner surfaces 14*b* and 16*b* are preferably substantially parallel with one another but tilted to form an angle θ with a plane perpendicular to the axis of rotation 23. It is to be understood, however, and as described more fully below, that it is also within the ambit of the present invention to have non-parallel layers of abrasive particles, or layers which may not be parallel but that follow contours of any adjacent layer. It is also contemplated that inner surfaces 14*b* and 16*b* can be perpendicular to the axis of rotation 23 rather than tilted.

Abrasive region 12 is preferably substantially cylindrical having an upper surface 31 and a lower surface 33 which are substantially parallel with one another and also preferably tilted at angle θ with a plane perpendicular to axis of rotation 23. In this way, abrasive region 12 can be supported between support plates 14 and 16 at angle θ to a plane perpendicular to axis of rotation 23 of wheel 10. Because top surface 14*a* of plate 14 and bottom surface 16*a* of plate 16 can be substantially perpendicular to axis of rotation 23, surfaces 31 and 33 can be tilted at angle θ with respect to surfaces 14*a* and 16*a*. It is to be understood that support plates 14 and 16 are optional. To facilitate rotation of a grinding wheel formed without support plates 14 and 16, a rotatable shaft can be fixed directly to upper and lower surfaces 31 and 33, respectively.

Figure 2:
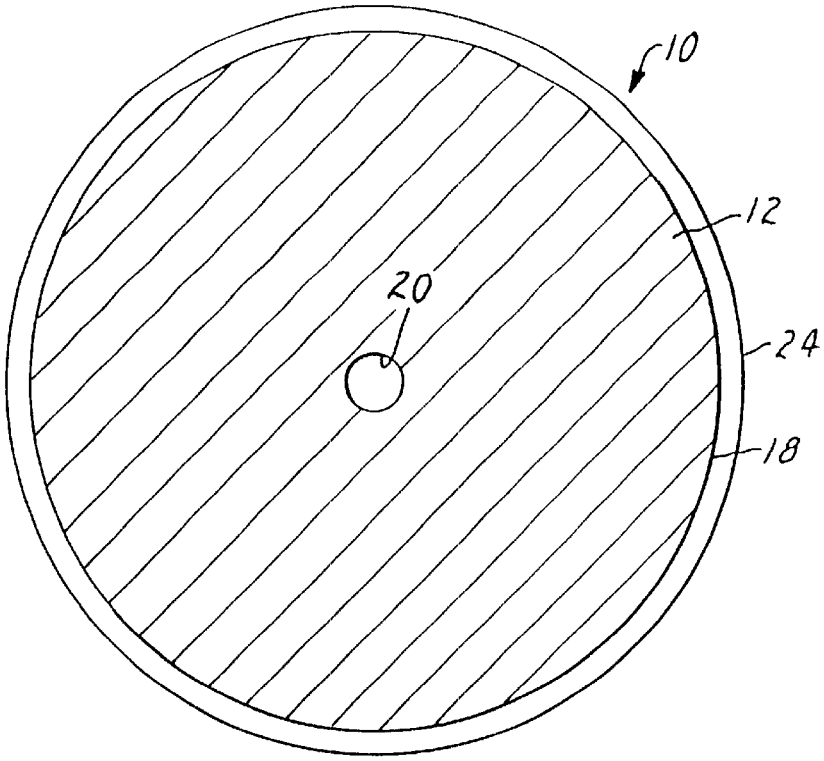
FIG. 2 is a cross-sectional view of the grinding wheel shown in FIG. 1 taken along section line 2—2 of FIG. 1.

As shown in FIG. 2, which is a sectional view of wheel 10 taken along line 2—2 of FIG. 1, abrasive region 12 is annular, extending radially inward from surface 24 towards the center of wheel 10. In this way, as outer abrasive surface 18 is worn down by use, additional abrasive surface is exposed, thus extending the useful life of wheel 10. In the embodiment shown in FIG. 2, abrasive region 12 extends through the entire radial distance between circumferential surface 24 and bore 20. It is also contemplated, however, that abrasive region 12 extend radially through only of portion of the region between surface 24 and bore 20.

Abrasive region 12 contains particles of abrasive or hard material including, but not limited to, superabrasives such as diamond, cubic boron nitride, boron carbide, boron suboxide, and other abrasive particles such as silicon carbide, tungsten carbide, titatnium carbide, and chromium boride suspended in a matrix of filler or bond material. As shown in FIG. 3, in accordance with the present invention, the abrasive particles can be arranged in substantially planar, parallel layers 26 in abrasive region 12 with regions of bond material 28 between the layers 26 of abrasive particles. Abrasive particle layers 26 can define a plane which extends in a radial and circumferential direction in wheel 10. As shown in FIG. 3, which is a front view of wheel 10, abrasive surface 18 can be formed to cut across the layers 26 of abrasive particles, represented by dashed lines. In this way, the edges of abrasive particle layers 26 can be exposed at abrasive surface 18. Also, the edges of the regions of bond material 28 are exposed at surface 18.

Figure 4:
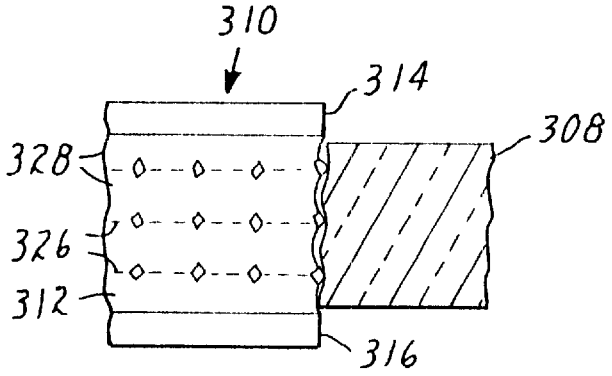
FIG. 4 is a partial side view in cross section of an abrasive grinding wheel grinding a workpiece illustrating how layers of abrasive particles between bond regions on the abrasive surface of the grinding wheel can cause grooving of the grinding wheel and workpiece.

Exposing the edges of layers 26 at surface 18 affects the shape, wear profile, or surface morphology of surface 18 as tool 10 is used. It also affects the profile of a surface of a workpiece which has been ground using tool 10. This is because the regions of bond material 28 will wear more rapidly and cut a workpiece less effectively than the abrasive particle layers 26. FIG. 4 is a side view illustrating the wear profile a grinding wheel 310 and a workpiece 308 that has been abraded thereby. Wheel 310 has abrasive region 312 which can be sandwiched between support plates 314 and 316. Abrasive region 312 includes abrasive particle layers 326 separated by bond material regions 328. Edges of layers 326 are aligned in a plane perpendicular to the axis of rotation 323 of wheel 310, and each edge of layer 326 extends continuously around the perimeter of wheel 310. As shown, grinding the edge of workpiece 308 using wheel 310 can result in grooving in abrasive region 312. The high spots of the grooves of abrasive region 312 occur at the edges of abrasive particle layers 326 and low spots occur at the regions of bond material 328. As shown, this grooving can be mirrored in the surface of workpiece 308 which is being ground because the edges of the abrasive particle layers 326 will remove workpiece material more rapidly than the surrounding regions of bond material 328.

However, as noted in the Background section, it is generally desirable to produce a smooth, surface on a workpiece surface. For example, manufacturers of glass for automobiles and furniture use pencil wheels to grind the edges of glass to be smooth and relatively free of defects. Therefore, to reduce grooving or other surface anomalies in a workpiece, as shown in FIG. 3, abrasive particle layers 26 can be tilted at an angle θ to a plane perpendicular to the axis of rotation 23. Angle θ is preferably between 0 degrees and 180 degrees, exclusive. Abrasive particle layers 26 are preferably tilted far enough such that any path 32 defined by the intersection of a plane perpendicular to the axis of rotation of wheel 10 and a complete circumference of abrasive surface 18 will intersect or cut across at least one abrasive particle layer 26. Thus, the entirety of a surface of a workpiece ground by wheel 10 can be ground at substantially the same rate and fewer grooves or other anomalies are formed due to a region of the surface being ground only by bond material or, alternatively, a disproportionately large amount of abrasive particles.

Figure 5A:
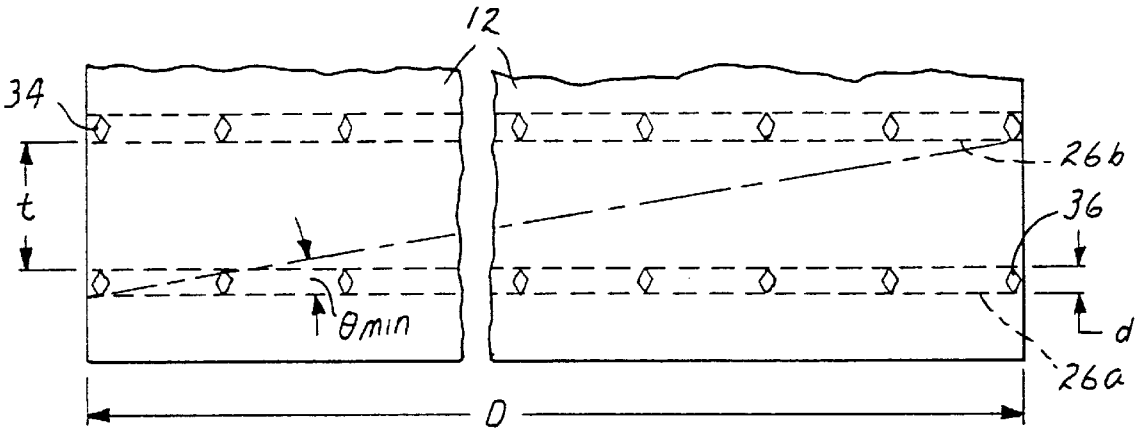
FIG. 5*a* is a partial front view of a sheet of abrasive material which can be used to fabricate the grinding wheel shown in FIG. 1 showing abrasive particles and abrasive particle layers exaggerated for purposes of illustration.
Figure 5B:
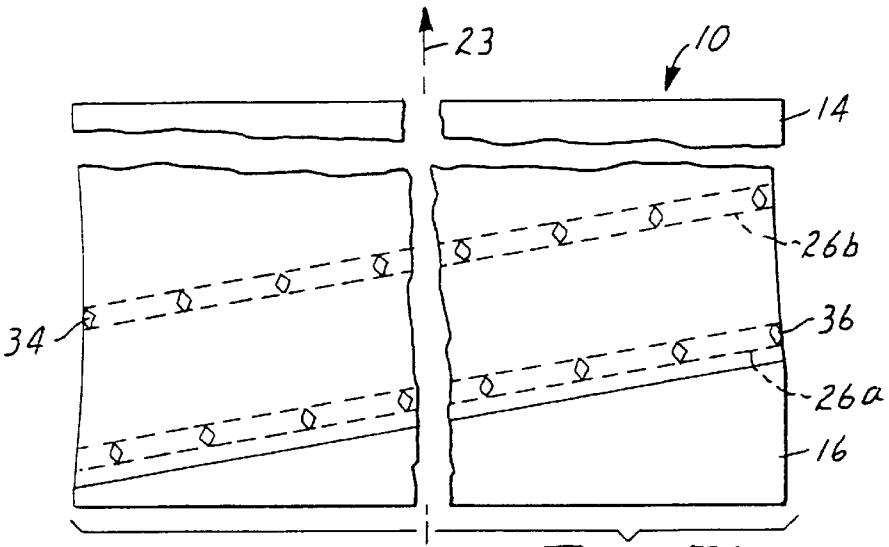
FIG. 5*b* is a partial front view of the grinding wheel shown in FIG. 1 showing abrasive particle layers exaggerated for purposes of illustration and tilted with respect to an axis of rotation of the grinding wheel.

The minimum angle $\theta_{min}$ at which abrasive region 12 should be tilted to a plane perpendicular to the axis of rotation of wheel 10 so that any path 32 will cut across at least one abrasive particle layer 26 depends upon the size of the particles used in forming abrasive region 12, the diameter of wheel 10, and the thickness of the regions of bond material 28 between the abrasive particle layers 26. FIGS. 5*a* and 5*b* show schematic illustrations of partial views of an abrasive material of the type from which wheel 10 can be formed. Two abrasive particles 34 and 36 are in adjacent abrasive particle layers 26*a* and 26*b*, respectively, represented by dashed lines. FIG. 5*a* shows a schematic of cylindrical abrasive region 12 before being tilted in wheel 10 to illustrate a method for determining $\theta_{min}$. Particles 34 and 36 are diametrically opposed to one another across a diameter of the wheel 10. Thus, particles 34 and 36 are at a distance from each other which would equal the diameter D of abrasive region 12. Abrasive particle layers 26*a* and 26*b* are at a separation t between each other. An abrasive particle has a diameter d. Thus, angle $\theta_{min}$ is given by the equation:

$$\theta_{min}=\arctan(d+t/D)$$

For example, for a 4 inch diameter wheel (D=4 inches) having separation between adjacent particle layers of 0.05 inches (t=0.05 inches) and abrasive particle diameter of 0.01 inches (d=0.01 inches), angle $\theta_{min}$ is approximately 0.86 degrees. FIG. 5*b* shows a schematic illustration of wheel 10 after cylindrical abrasive region 12 has been tilted through angle $\theta_{min}$ and sandwiched between support plates 14 and 16. While the above equation gives the minimum tilt angle $\theta_{min}$ for abrasive region 12 to generally insure that a path 32 will intersect an edge of an abrasive particle layer, it is also within the ambit of the present invention to tilt abrasive region 12 at an angle θ greater than $\theta_{min}$. It is also considered to tilt abrasive region 12 at an angle less than that given by $\theta_{min}$, however, if such a tilt angle θ less than $\theta_{min}$ were used, a path 32 defined by the intersection of a plane perpendicular to the axis of rotation 23 and a circumference of abrasive region 12 may not intersect with an edge of an abrasive particle layer.

The above discussion regarding angle $\theta_{min}$ assumes that the same diameter d of abrasive particles is used throughout the abrasive region 12 and that the separation t between adjacent abrasive particle layers is substantially the same throughout the abrasive region 12. It is within the scope of the present invention, however, to use different diameter abrasive particles and different separations between adjacent layers of abrasive particles. Nonetheless, the above equation for angle $\theta_{min}$ is useable if the greatest separation between adjacent abrasive particle layers is used for the separation t. Further, the above equation for $\theta_{min}$ only applies if the layers of abrasive particles in the abrasive region are substantially planar and parallel to each other.

Figure 6:
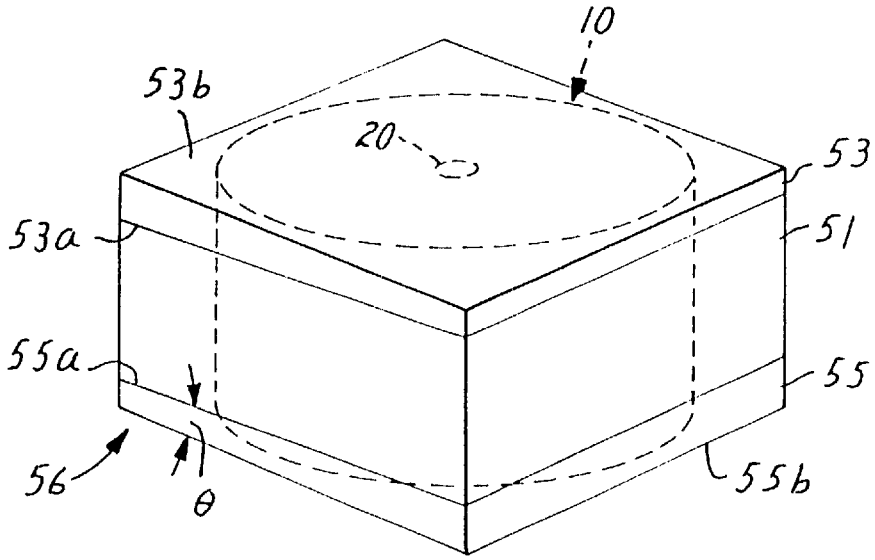
FIG. 6 is a perspective view of a laminated block from which the abrasive grinding wheel shown in FIG. 1 can be formed.
Figure 7:
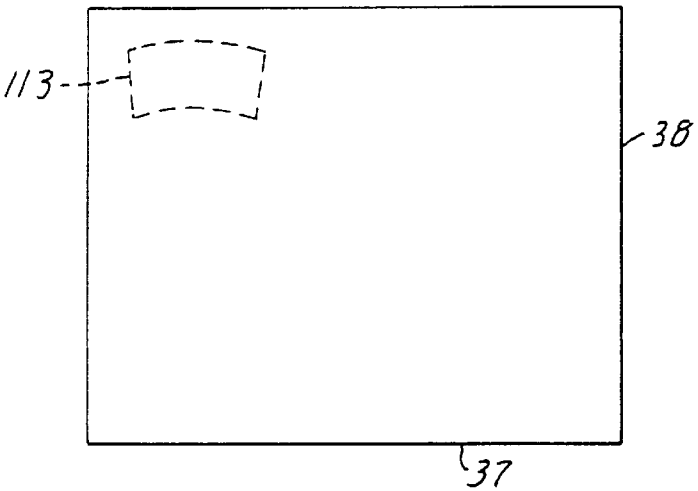
FIG. 7 is a top view of a laminated sheet from which an abrasive region of the grinding wheel shown in FIG. 1 can be formed.
Figure 8:
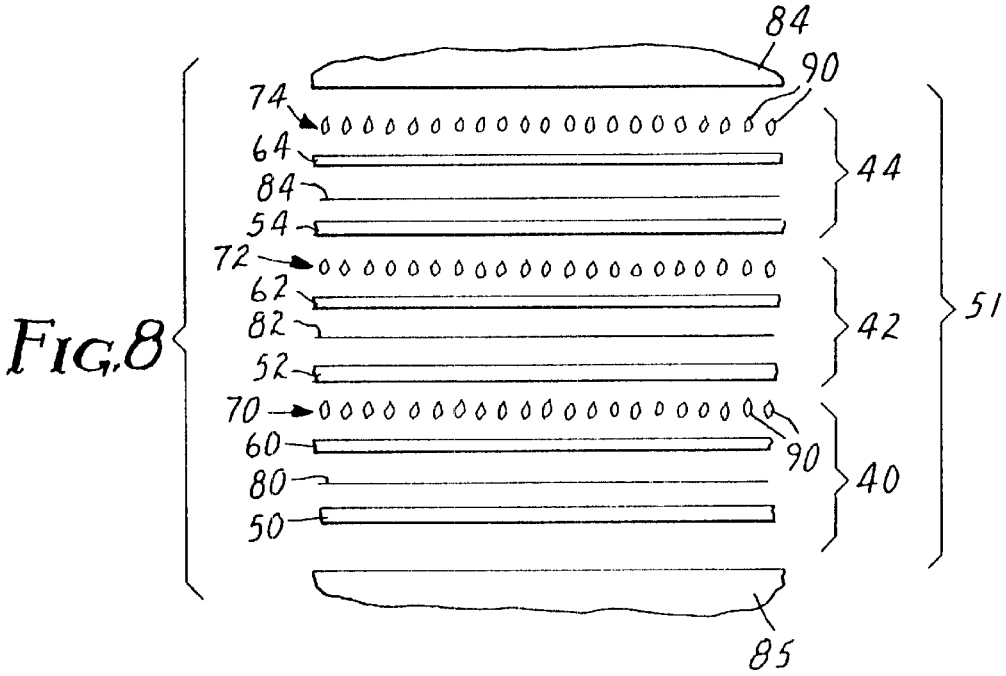
FIG. 8 is an exploded front view of an example of a laminated sheet such as that shown in FIG. 7.

FIG. 6 shows one embodiment of a method of fabricating wheel 10 and FIGS. 7 and 8 show a laminated sheet 51 of abrasive material having layers of abrasive particles therein. A method for fabricating laminated sheet 51 of abrasive material is detailed below. It is to be understood that sheet 51 can preferably be formed as discussed below prior to carrying out the steps of assembling wheel 10. As shown in FIG. 6, sheet 51 is stacked with first outer plate 53 and second outer plate 55 to form rectangular block 56. This block 56 can then be sintered under pressure. Generally, this sintering step is performed at temperatures between about 480° C. and 1600° C., at pressures as high as 100 to 550 kg/cm$^2$, and with dwell times from about 5 minutes to 1 hour. Block 56 can then be cut, as shown in phantom, by laser, water jet, EDM (electrical discharge mechanism), plasma electron-beam, scissors, blades, dies, or other known method, to form wheel 10. Bore 20 can be cut, as shown in phantom, using the same or other method either before or after cutting wheel 10 from block 56. It should be understood that the shape of block 56 and/or sheet 51 is not limited to the rectangular shape but can be any shape including round, with or without an inside opening which can also be any shape.

Depending upon the design, wheel 10 may have an axially thin or thick abrasive region 12. Abrasive region 12 can then be mounted on a core, such as a metallic or composite core. The core can be integrated with abrasive region 12 by any available means that includes but is not limited to mechanical locking and tensioning/expansion, brazing, welding, adhering, sintering and forging.

For extracting wheel 10 out of sheet 51, it is advantageous to use cutting machines with a cutting media characterized by being able to move in 3 to 5 degrees of freedom. For example, a laser or a water jet having nozzles which can move in 5 degrees of freedom.

First and second outer plates 53 and 55, respectively can be formed from steel, aluminum, bronze, resin, or other substantially rigid material by known methods. In forming plates 53 and 55, inner surface 53*a* of first plate 53 is preferably angled at angle θ to outer surface 53*b* thereof and inner surface 55*a* of second plate 55 is preferably angled at angle θ to outer surface 55*b* thereof.

Alternately, an annular abrasive region can be cut from a sheet of abrasive material prior to sintering first support plate 14 and second support plate 16 therewith. First support plate 14 and second support plate 16 can also be formed prior to sintering. The annular abrasive region can then be layered with support plates 14 and 16 and sintered under pressure to form a grinding wheel in accordance with the present invention.

A second alternate method for forming an abrasive wheel having a tilted abrasive region in accordance with the present invention includes forming a top plate and bottom plate each having parallel inner and outer surfaces. Sheet 51 can then be sandwiched and sintered between the top and bottom plates. A bore with which to mount the abrasive wheel on a rotating shaft can then be formed at an angle other than 90 degrees with the inner and outer surfaces of the top and bottom plates. The wheel could optionally be dressed while mounted.

A third alternate method for forming an abrasive wheel in accordance with the present invention includes forming an abrasive region from sheet 51 in which the layers of abrasive particles are at an angle between 0 degrees and 180 degrees, exclusive, with substantially parallel top and bottom surfaces of the abrasive region. Such an abrasive region can be formed by cutting the abrasive region from a sheet such as sheet 51 using cuts that are at an angle between 0 degrees and 180 degrees with an upper or lower face of sheet 51. The abrasive region can preferably be sandwiched between upper and lower support plates each having substantially parallel interior and exterior surfaces. Preferably, a bore can be formed through the support plates and the abrasive region substantially perpendicular to the top and bottom surfaces of the abrasive region. In this way, a rotating shaft placed through the bore results in the abrasive wheel having an abrasive region with layers of abrasive particles that are at an angle between 0 degrees and 180 degrees, exclusive, with respect to a plane perpendicular to an axis of rotation of the abrasive wheel.

After forming wheel 10 using any of the above described methods, abrasive surface 18 can be dressed using known processes to recess or curve in from the remainder of the outer perimeter 24 of wheel 10, as shown in FIG. 1. It is also contemplated to dress wheel 10 to have other shapes of abrasive surface 18 as a specific application may require.

Examples include convex, concave, and more complicated surfaces such as "ogee."

Another method of fabricating wheel 10 having a concave, convex, or other abrasive surface 18 is by extracting various rings or rims from sheet 51 having varying diameters and then stacking the rings. For example to fabricate a wheel having a concave abrasive surface, rings having varying outer diameters can be extracted from sheet 51. The rings can then be stacked on a core so that the resulting wheel has the desired concave shape.

A method of fabrication of sheet 51 having substantially parallel layers of abrasive particles is fully disclosed in co-pending U.S. patent application Ser. No. 08/882,434 filed on Jun. 25, 1997, entitled "Superabrasive Cutting Surface", currently assigned to the assignee of the present invention, and which is hereby incorporated by reference in its entirety.

FIG. 7 is a top view of laminated sheet 51. In the embodiment of FIG. 7, laminated sheet 51 is square with a front edge 37 and a side edge 38. However, other shapes of laminated sheet 51 are also within the scope of the present invention. Sheet 51 is made up of a plurality of thickness layers. Each thickness layer preferably includes a layer of bond material and a layer of abrasive particles. Each thickness layer of sheet 51 can also include a layer of porous material and/or adhesive substrate.

FIG. 8 is an exploded front view of front edge 37 of sheet 51 showing the stack up of thickness layers which can be used in the fabrication of sheet 51. For purposes of illustration in the embodiment of FIG. 8, sheet 51 is made up of only three thickness layers 40, 42, and 44. However, sheet 51 can be made up of a different number of thickness layers and is preferably made up of from 2 to 10,000 layers. Each thickness layer 40, 42, and 44 includes a bond material layer 50, 52, and 54, respectively; a porous material layer 60, 62, and 64, respectively; and an abrasive particle layer 70, 72, and 74, respectively, comprising abrasive particles 90. Each thickness layer 40, 42, and 44 may also include adhesive layers 80, 82, and 84, respectively, placed on one face of the porous material layers 60, 62, and 64, respectively, and each having at least one face which includes a pressure sensitive adhesive. The adhesive face of the adhesive layers 80, 82, and 84 are positioned against the porous layers 60, 62, and 64, respectively. In this way, when abrasive particles 90 of abrasive particle layers 70, 72, and 74 are placed in the openings of the porous layers 60, 62, and 64, respectively, the abrasive particles 90 adhere to the adhesive layers 80, 82, and 84 such that the abrasive particles 90 are retained in the openings of the porous layers 60, 62, and 64. It should be understood that the above mentioned porous layers may be selected from, for example, mesh-type materials (e.g., woven and non-woven mesh materials, metallic and non-metallic mesh materials), vapor deposited materials, powder or powder-fiber materials, and green compacts, any of which include pores or openings distributed throughout the material. It should also be understood that the order or placement of the various layers may be different than shown.

The porous layer may be separated or removed from the adhesive layer after the abrasive particles have been received by the adhesive layer. The use of adhesive substrates to retain abrasive particles to be used in a sintering process is disclosed in U.S. Pat. No. 5,380,390 to Tselesin and U.S. Pat. No. 5,620,489 to Tselesin and U.S. patent application Ser. No. 08/728,169, filed Oct. 9, 1996, each of which is hereby incorporated by reference in its entirety.

Thickness layers 40, 42, and 44 are compressed together by top punch 84 and bottom punch 85 to form sintered laminated sheet 51. As noted above, sintering processes suitable for the present invention are known in the art and described in, for example, in U.S. Pat. No. 5,620,489, to Tselesin, which has been incorporated by reference in its entirety. Though FIG. 8 shows a single bond material layer for each thickness layer 40, 42, and 44, it is also contemplated to include 2 or more bond layers for each thickness layer 40, 42, and 44.

In carrying out the above fabrication process, the bond material making up bond material layers 50, 52 and 54 can be any material sinterable with the abrasive particle layers 70, 72, and 74 and is preferably soft, easily deformable flexible material (SEDF) the fabrication of which is known in the art and is disclosed in U.S. Pat. No. 5,620,489, which has been incorporated by reference in its entirety. Such SEDF can be formed by forming a paste or slurry of bond material or powder such as tungsten carbide particles or cobalt particles, and a binder composition including a cement such as rubber cement and a thinner such as rubber cement thinner. Abrasive particles can also be included in the paste or slurry but need not be. A substrate is formed from the paste or slurry and is solidified and cured at room temperature or with heat to evaporate volatile components of the binder phase. The SEDF used in the embodiment shown in FIG. 5 to form bond material layers 50, 52, and 54 can include methylethylketone:toluene, polyvinyl butyral, polyethylene glycol, and dioctylphthalate as a binder and a mixture of copper, iron, nickel, tin, chrome, boron, silicon, tungsten carbide, titanium, cobalt, and phosphorus as a bond matrix material. Certain of the solvents will dry off after application while the remaining organics will burn off during sintering. An Example of an exact composition of an SEDF that may be used with the present invention is set out below in the Examples. Components for the composition of such an SEDF are available at a number of suppliers including: Sulzer Metco, Inc. of Troy, Mich.; All-Chemie, Ltd. of Mount Pleasant, S.C.; Transmet Corp. of Columbus, Ohio.; Valimet, Inc., of Stockton, Calif.; CSM Industries of Cleveland, Ohio; Engelhard Corp. of Seneca, S.C.; Kulite Tungsten Corp. of East Rutherford, N.J.; Sinterloy, Inc. of Selon Mills, Ohio; Scientific Alloys Corp. of Clifton, N.J.; Chemalloy Company, Inc. of Bryn Mawr, Pa.; SCM Metal Products of Research Triangle Park, N.C.; F. W. Winter & Co. Inc. of Camden, N.J.; GFS Chemicals Inc. of Powell, Ohio; Aremco Products of Ossining, N.Y.; Eagle Alloys Corp. of Cape Coral, Fla.; Fusion, Inc. of Cleveland, Ohio; Goodfellow, Corp. of Berwyn, Pa.; Wall Colmonoy of Madison Hts, Mich.; and Alloy Metals, Inc. of Troy, Mich. It should also be noted that not every bond layer forming sheet 36 need be of the same composition; it is contemplated that one or more bond material layers could have different compositions.

The porous material can be virtually any material so long as the material is substantially porous (about 30% to 99.5% porosity) and preferably comprises a plurality of non-randomly spaced openings. Suitable materials are organic or metallic non-woven, or woven mesh materials, such as copper, bronze, zinc, steel, or nickel wire mesh, or fiber meshes (e.g. carbon or graphite). Particularly suitable for use with the present invention are stainless steel wire meshes, expanded metallic materials, and low melting temperature mesh-type organic materials. In the embodiment shown in FIG. 8, a mesh is formed from a first set of parallel wires crossed perpendicularly with a second set of parallel wires to form porous layers 60, 62, and 64. The exact dimensions of a stainless steel wire mesh which can be used with the present invention is disclosed below in the Example.

Figure 9:
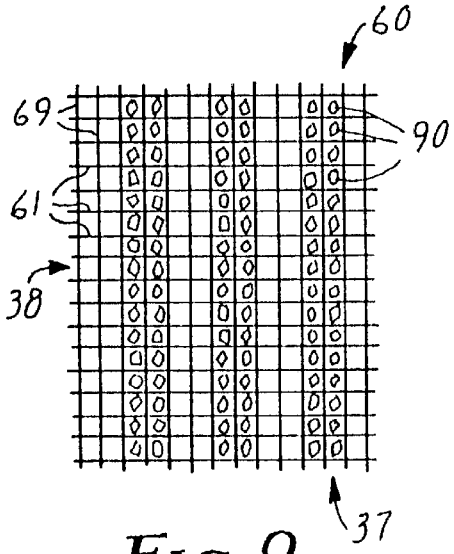
FIG. 9 is a top view of a first embodiment of porous material which can be used to fabricate the laminated sheet shown in FIG. 7.
Figure 10:
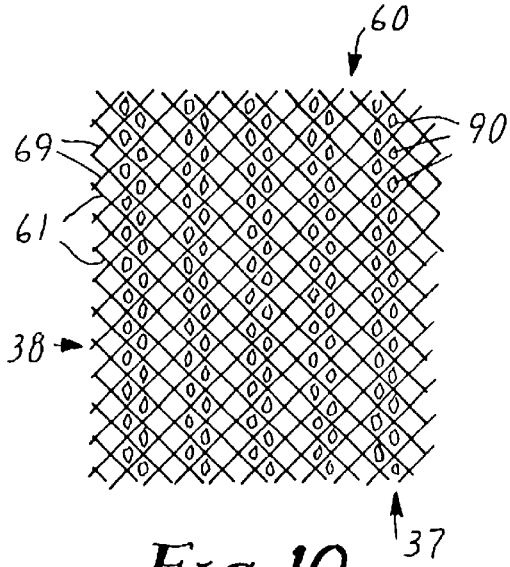
FIG. 10 is a top view of a second embodiment of porous material which can be used to fabricate the laminated sheet shown in FIG. 7.

As shown in FIG. 9, which is a top view of a single porous layer 60 of sheet 51 having abrasive particles 90 placed therein, a first set of parallel wires 61 can be placed parallel with front edge 37 of sheet 51 and the second set of parallel wires 69 can be placed parallel to side edge 38. However, as shown in FIG. 10 it is also possible to angle the porous layer such that the sets of parallel wires 61 and 69 are at an approximately 45 degree angle with front edge 37 and side edge 38. It is also contemplated to form sheet 51 having some layers using the configuration of FIG. 10 and some layers using the configuration of FIG. 9.

The abrasive particles 90 can be formed from any relatively hard substance including superabrasive particles such as diamond, cubic boron nitride, boron suboxide, boron carbide, silicon carbide and/or mixtures thereof. Preferably diamonds of a diameter and shape such that they fit into the holes of the porous material are used as abrasive particles 90. It is also contemplated to use abrasive particles that are slightly larger than the holes of the porous material and/or particles that are small enough such that a plurality of particles will fit into the holes of the porous material.

The adhesive layers 80, 82, and 84 can be formed from a material having a sufficiently tacky quality to hold abrasive particles at least temporarily such as a flexible substrate having a pressure sensitive adhesive thereon. Such substrates having adhesives are well known in the art. The adhesive must be able to hold the abrasive particles during preparation, and preferable should bum off ash-free during the sintering step. An example of a usable adhesive is a pressure sensitive adhesive commonly referred to as Book Tape #895 available from Minnesota Mining and Manufacturing Company (St. Paul, Minn.).

Figure 11:
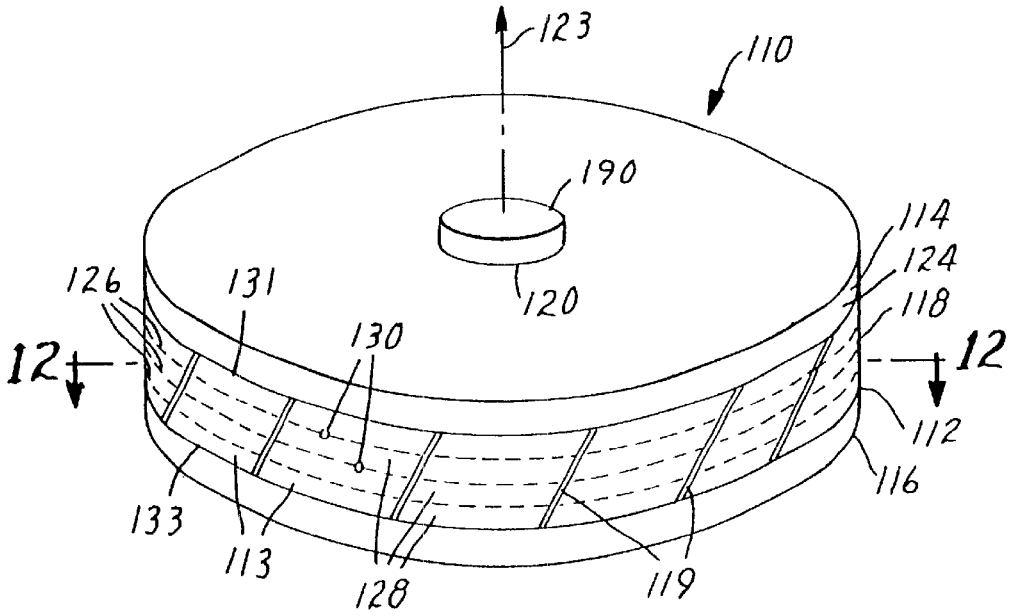
FIG. 11 is a perspective view of a second embodiment of an abrasive grinding wheel including abrasive segments having abrasive particle layers in accordance with the present invention.

Another embodiment of the present invention is shown in FIGS. 11–17. Like elements are labeled with like numbers throughout FIGS. 11–17. FIG. 11 shows a grinding wheel 110 having a first support plate 114, a second support plate 116 and an abrasive region 112 sandwiched therebetween. Grinding wheel 110 is generally cylindrical and has bore 120 passing through a top and bottom face thereof Like wheel 10, wheel 110, via bore 120, can be mounted on a rotatable shaft (not shown) and rotated about axis of rotation 123. Abrasive region 112 has a substantially cylindrical abrasive surface 118 extending around a perimeter surface 124 of wheel 110. Unlike abrasive region 12 of wheel 10, upper surface 131 and lower surface 133 of abrasive region 112 are illustrated as substantially aligned with a plane which is substantially perpendicular to the axis of rotation 123 of wheel 110.

Abrasive region 112 is made up of abrasive segments 113 which can have substantially planar, parallel layers 126 of abrasive particles, represented in FIG. 11 by dashed lines. However, it is also within the scope of the present invention to have non-parallel layers or layers which may not be parallel but that follow the contours of any adjacent layer. Abrasive segments 113 are circumferentially spaced about the perimeter of wheel 110 and are supported between first support plate 114 and second support plate 116. With the provision of plural discrete abrasive segments 113, gaps 119 can advantageously exist between adjacent abrasive segments 113. As shown in FIG. 11, gaps 119 are substantially rectangular and extend between upper and lower surfaces 131 and 133, respectively, at an angle other than 90 degrees thereto. The segments 113 and gaps 119 should be arranges so that before a workpiece looses contact with a first segment 113 during grinding it comes into contact with an adjacent segment 113. This can advantageously reduce noise or "chatter" generated by grinding a workpiece against wheel 110. It is also contemplated, however, that gaps 119 extend between upper and lower surfaces 131 and 133, respectively, at substantially a 90 degree angle thereto.

Figure 12:
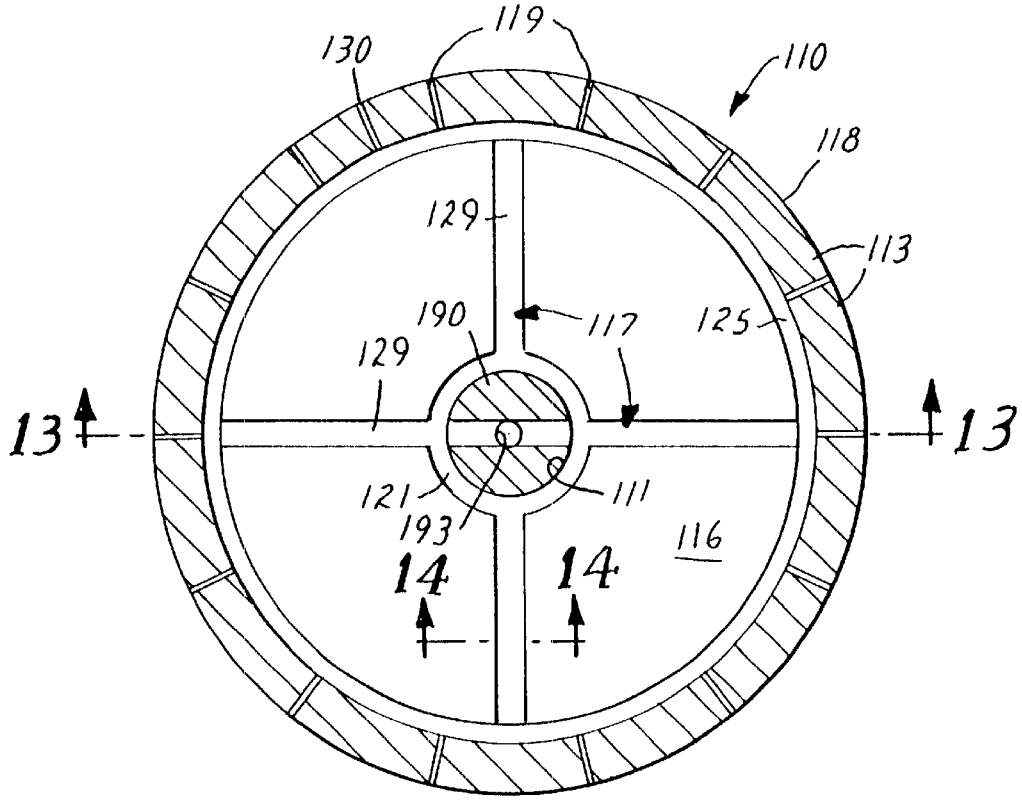
FIG. 12 is a cross-sectional view of the grinding wheel shown in FIG. 11 taken along section line 12—12 of FIG. 11.
Figure 13:
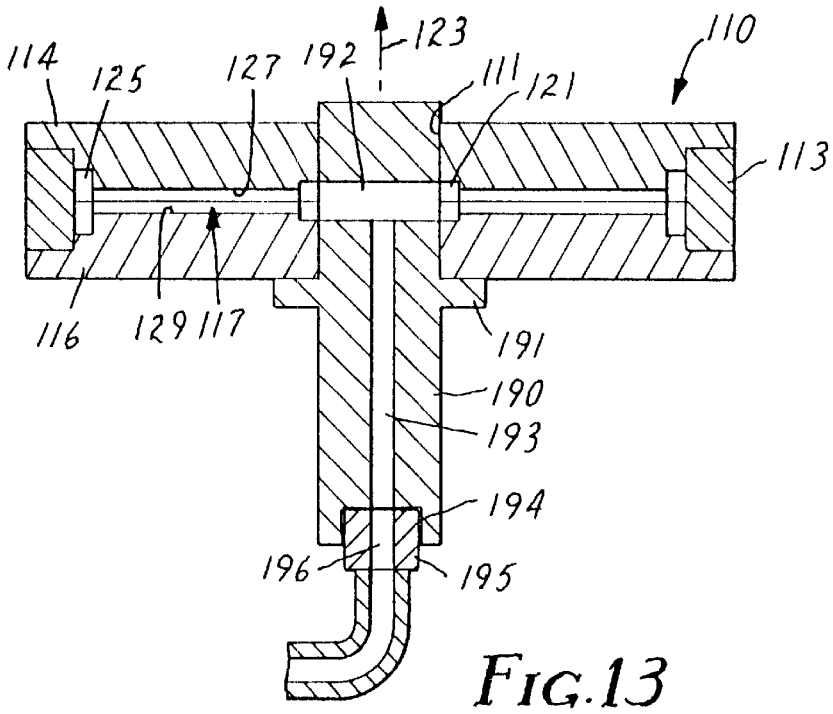
FIG. 13 is a cross-sectional view of the grinding wheel shown in FIG. 12 taken along section line 13—13 of FIG. 12.
Figure 14:
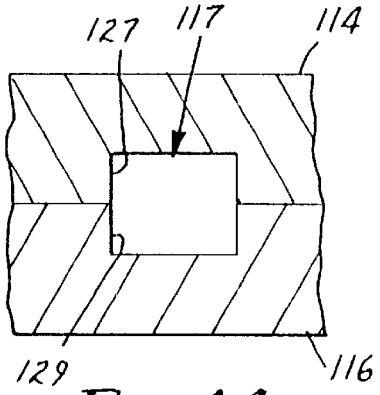
FIG. 14 is a cross-sectional view of the grinding wheel shown in FIG. 12 taken along section line 14—14 of FIG. 12.

As shown in FIG. 12, which is a sectional view of wheel 110 taken along section line 12—12 of FIG. 11, wheel 110 has radial distribution channels 117. As shown in FIGS. 13 and 14, which are sectional views of wheel 110 taken along section lines 13—13 and 14—14, respectively, of FIG. 12, radial distribution channels 117 are formed from generally U-shaped troughs or channels 127 and 129 cut in support plates 114 and 116, respectively. Radial distribution channels 117 preferably extend from a circular distribution channel 121 near the center of wheel 110 radially outward to a circumferential distribution channel 125. Circular channel 121 is preferably formed in support plates 114 and 116 from generally U-shaped troughs 127 and 129 to extend around an inside circumferential edge 111 of wheel 110. Circumferential distribution channel 125 passes radially behind or interior to abrasive segments 113. A lubricant, such as water, can be fed under pressure into circular distribution channel 121 to pass through radial distribution channels 117 and into circumferential distribution channel 125. The lubricant is then forced through gaps 119 between segments 113 to lubricate abrasive surface 118 during grinding. Alternately, as shown in FIGS. 11 and 12, segments 113 can include openings 130 which place the perimeter of wheel 110 in fluid communication with distribution channel 125 and through which lubricant can be delivered to the abrasive surface 118 during grinding. Openings 130 can be of a variety of shapes including circular, square, polygonal, or any other shape. Each opening 130 may taper throughout the thickness of segment 113. Wheel 110 can include openings 130 either with or without gaps 119. Either with or without openings 130, wheel 110 can be used with a center waterfeed grinder. Use of a lubricant on grinding surface 118 during grinding can increase the useful life of wheel 110 and improve workpiece finish. Although the embodiment shown in FIG. 12 includes 4 radial distribution channels 117, it is also within the scope of the present invention to include fewer or greater than 4 channels 117.

Distribution channels 121, 117 and 125 are formed from generally U-shaped troughs 127 and 129 machined or otherwise formed in inside surfaces of plates 114 and 116, respectively. When plates 114 and 116 are mounted on top of one another, troughs 127 and 129 are aligned to form channels 121, 117 and 125.

As shown in FIG. 13, to feed a lubricant into circular distribution channel 121, wheel 110 is mounted on spindle 190. Spindle 190 includes flange 191, longitudinal distribution channel 193, and transverse distribution channel 192. Wheel 110 rests on flange 191 so that transverse distribution channel 192 is aligned with circular distribution channel 121 and is in fluid communication therewith. Longitudinal distribution channel 193 intersects transverse distribution channel 192 and is in fluid communication therewith. Longitudinal channel 193 opens at one end of spindle 190 at coupling 194. Coupling 194 allows spindle 190 to be connected to a water feed spout 195 such that spindle 190 can rotate about axis of rotation 123 on spout 195, and longitudinal channel 193 can be in sealed fluid communication with interior channel 196 of spout 195. Such sealed connections are known in the art. Spindle 190 can rotate with wheel 110 such that lubricant can be fed through interior channel 196, through longitudinal channel 193, into transverse channel 192 and into circular distribution channel 121. It is also contemplated that wheel 110 rotate with respect to spindle 190. Spindle 190 can be formed of steel or other rigid material and distribution channels 192 and 193 can be formed therethrough by drilling or other known methods.

Figure 15:
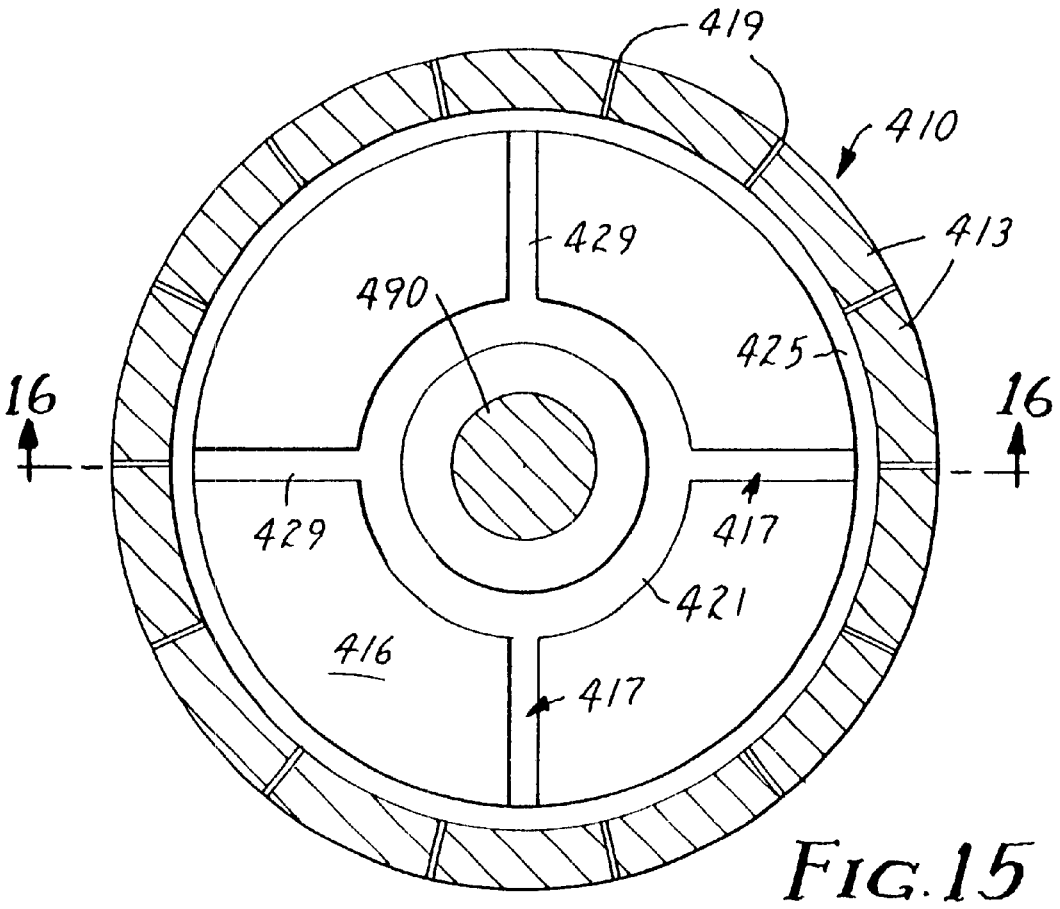
FIG. 15 is a top cross-sectional view, taken along the same section line as FIG. 12, of another embodiment of a grinding wheel in accordance with the present invention.
Figure 16:
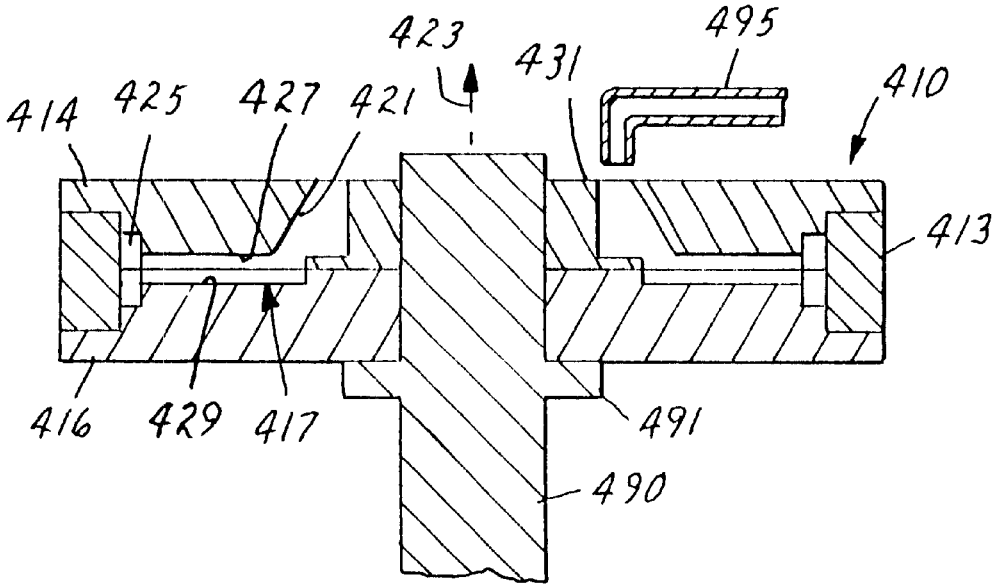
FIG. 16 is a cross-sectional view of the grinding wheel shown in FIG. 15 taken along line 16—16 of FIG. 15.

An alternate method of feeding liquid lubricant through distribution channels in a grinding wheel in accordance with the present inventions is shown in FIGS. 15 and 16. FIG. 15 is a top sectional view, taken along the same section line as the sectional view of grinding wheel 110 shown in FIG. 12, of a grinding wheel 410 in accordance with the present invention. Like grinding wheel 110, grinding wheel 410 includes abrasive segments 413 arranged about a perimeter thereof, a circumferential distribution channel 425 extending radially behind or interior to abrasive segments 413, and radial distribution channels 417 in fluid communication with circumferential distribution channel 425. However, grinding wheel 410 includes circular distribution channel 421 which is open along upper face 431 of wheel 410. As shown in FIG. 16, which is a sectional view of wheel 410 take along section line 16—16 of FIG. 15, circular distribution channel 421 is in fluid communication with radial distribution channels 417. As such, liquid lubricant can be fed into circular distribution channel 421 via a stationary spout 495 while wheel 410 is rotated by spindle or rotatable shaft 490 and be fed into distribution channels 417, through circumferential distribution channel 425 and through gaps 419 and/or openings (not shown) in segments 413 to lubricate the grinding surface of wheel 410. Wheel 410 can be fabricated in substantially the same manner as wheel 110.

Figure 17:
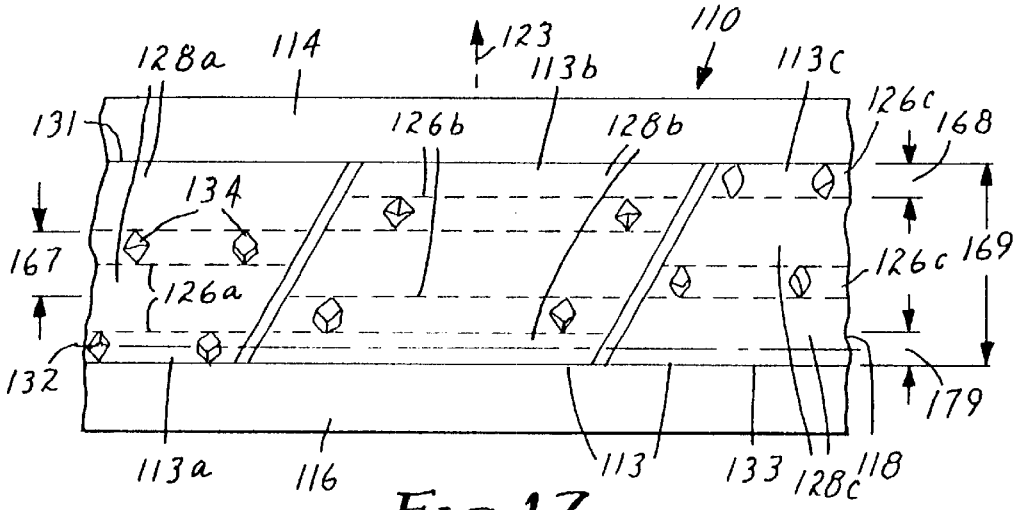
FIG. 17 is a front view of the grinding wheel shown in FIG. 11 showing abrasive particles and abrasive particle layers exaggerated for purposes of illustration.

Returning attention now to wheel 110, as noted above, abrasive region 112 can be formed from abrasive segments 113 having layers 126 of abrasive particles. Preferably, layers 126 are substantially planar and parallel, but need not be. Moreover, the layers of abrasive particles 126 can be arranged to be in a plane perpendicular to the axis of rotation. As shown in FIG. 17, which is a partial front view of wheel 110 having abrasive particles 134 and abrasive particle layers 126*a,* 126*b,* and 126*c* exaggerated for purposes of illustration, abrasive particle layers 126*a,* 126*b,* and 126*c* are shown in a plane substantially perpendicular to axis of rotation 123. However, to ensure complete and smooth abrasion, layers 126*a,* 126*b,* and 126*c* are offset in an axial direction (direction of the axis of rotation 123) between segment one 113 to another segment 113. That is, layers 126 are not circumferentially aligned from one segment 113 to an adjacent segment 113. It is within the ambit of the present invention, however, not to axially shift abrasive particle layers 126 between adjacent segments, but rather, for example, between every 2nd or 3rd segment. All that is necessary is that abrasive particle layers 126 are axially shifted in some segment or segments around the perimeter of wheel 110.

Because abrasive particle layers 126 are not circumferentially aligned, neither are regions of bond material 128 between layers 126. Accordingly, as a workpiece is ground against abrasive surface 118, the likelihood that a some portion or portions of the surface of the workpiece being ground will contact only bond material regions 128 or only abrasive particle layers 126 is reduced and can be minimized. This reduces the likelihood that grooves or other surface anomalies will form on the surface of the workpiece being ground and facilitates the formation of a smooth surface on the workpiece.

An explanation of how circumferentially mis-aligning abrasive particle segments 113 in wheel 110 can facilitate the grinding of a smooth surface on a workpiece can be made with reference to FIG. 17. FIG. 17 is a front schematic view, exaggerated for purposes of illustration, of three segments 113*a,* 113*b,* and 113*c* having abrasive particle layers 126*a,* 126*b,* and 126*c,* respectively, and bond material regions 128*a,* 128*b,* and 128*c,* respectively. In the schematic illustration of FIG. 17, the axial height 169 of abrasive region 112 is approximately six times the diameter 168 of abrasive particles (or thickness of the abrasive particle layers) making up abrasive particle layers 126*a,* 126*b,* and 126*c*. The separation 167 between abrasive particle layers is shown to be approximately two times diameter 168.

Segment 113*a* is formed and placed in wheel 110 such that one of the two abrasive particle layers 126*a* provides a lower surface 133 of abrasive region 118. Bond material provides an upper surface 131 of abrasive region 118 and extends axially to abrasive particle layer 126*a* closest to upper surface 131. Segment 113*b* is formed and placed in wheel 110 such that one of the two abrasive particle layers 126*b* is spaced a distance 179 from the lower surface 133 of abrasive region 118. Distance 179 is preferably approximately equal to the abrasive particle diameter 168. Bond material fills the region between lower surface 133 and abrasive particle layer 126*b* closest to lower surface 133. Bond material also fills the region between upper surface 131 and abrasive particle layer 126*b* closest to upper surface 131. Segment 113*c* is formed and placed in wheel 110 such that one of the two abrasive particle layers 126*c* defines the upper surface 131 of abrasive region 118. Bond material fills the region between lower surface 133 and abrasive particle layer 126*c* closest to lower surface 133. For ease of illustration, in the embodiment shown in FIG. 17, segments 113*a,* 113*b* and 113*c* each include only two abrasive particle layers 126*a,* 126*b,* and 126*c,* respectively. However, it is within the ambit of the present invention to include more than two abrasive particle layers per segment. Further, the thickness of each abrasive particle layer and/or and diameter of abrasive particles used can vary between segments and within segments.

By staggering abrasive particle layers 126*a,* 126*b* and 126*c* as shown in FIG. 17, any path 132 defined by the intersection of a plane perpendicular to axis of rotation 123 and a full circumference of abrasive region 118 will intersect an abrasive particle layer 126 of at least one abrasive segment 113. This means that substantially all of a surface of a workpiece in contact with abrasive surface 118 as wheel 110 is being rotated will intersect an abrasive particle layer 126*a,* 126*b,* or 126*c*. As noted above, this facilitates forming a smooth edge or surface on a workpiece.

The sequence of staggered abrasive particle layers need not be as shown. It is only important that to accomplish smooth abrasion of a workpiece surface, the axial distance of the abrasive surface 118 should include at least a layer of abrasive particles to cover the axial distance.

Due to manufacturing variations, precise control of the thickness of abrasive particle layers 126 and bond material region 128, and alignment thereof, can be difficult. Accordingly, formation of wheel 110 precisely as shown in FIG. 17 can be difficult to achieve. As such, abrasive particle layers 126*a,* 126*b,* and 126*c* can be formed thicker to better facilitate overlap thereof between segments. Additionally, wheel 110 is preferably formed from more than three segments and can be formed with as many segments as can be accommodated around the perimeter of wheel 110. This creates a greater number of abrasive edges of abrasive layers 126 for a workpiece to pass across in a single rotation of wheel 110.

Segments 113 can be extracted, i.e. cut, from the laminated sheet 51 as shown in phantom in FIG. 7. Laminated sheet 51 should be at least partially sintered, and preferably fully sintered, prior to any extraction. First and second support plates 114 and 116, respectively, are solid and can be formed from steel, resin, or other substantially rigid material as known in the art. Troughs 127 and 129 can be machined, molded, or otherwise formed in plates 114 and 116, respectively, as known. Aperture 121 can be formed in plate 114 by drilling or other known method. Segments 113 are then stacked between plates 114 and 116 and brazed, or preferably, sintered therewith under pressure. When segments 113 are stacked with support plates 114 and 116, trough 127 in support plate 114 is axially aligned with trough 129 in support plate 116 so as to form channels 117 and 125, as shown in FIGS. 12, 13, and 14. Segments 113 can also be secured by adhesive, brazing, welding (including laser welding) or other known means between plates 114 and 116. It should be noted that if segments 113 are sintered with plates 114 and 116, this sintering process can be in addition to the sintering process, detailed above, used to form sheet 51 from which segments 113 can be cut. Bore 120 can be formed by drilling or other known process either before or after sintering plates 114 and 116 with segments 113.

To form segments 113 having differing distances between abrasive particle layers, such as segments 113*a*, 113*b*, and 113*c* shown in FIG. 17, segments can be cut from different laminated sheets having differing distances between layers 126. Also, in some cases such as segments 113*a* and 113*c*, segments are substantially the same as each other, but are inverted in wheel 110. Accordingly, it is considered to form such segments from the same sheet and inverting one or the other before final assembly the segments with plates 114 and 116.

To form laminated sheets such as sheet 51 but having differing distances between abrasive particle layers, greater or fewer layers of bond material layers such as layers 50, 52, or 54 shown in FIG. 8, can be placed between abrasive particle layers before sintering to form a sheet such as sheet 51. The number of bond material layers required to produce a given distance between abrasive particle layers can be determined empirically.

It is also within the ambit of the present invention to form wheel 110 having abrasive segments, such as abrasive segments 113, wherein the abrasive particle layers are at an angle between 0 degrees and 180 degrees with a plane perpendicular to the axis of rotation of grinding wheel 110. What is important is that abrasive surface 118, when rotated about axis of rotation 123, will sweep an edge of an abrasive particle layer 116 across an axial distance greater than the axial thickness of the edge at any given point.

It is to be understood that the segmented design of wheel 110 can also be formed with abrasive segments such as segments 113, having abrasive particles randomly distributed therein as discussed in the Background of the Invention section. Though segments such as segments 113 having randomly distributed particles would lack the advantages of segments 113 having layers of abrasive particles, to form a wheel such as wheel 110 using segments having randomly distributed particles would still allow liquid lubricant to be distributed to the grinding surface of the wheel during grinding using a grinding wheel having channels such as channels 117, 121, and 125.

Figure 18:
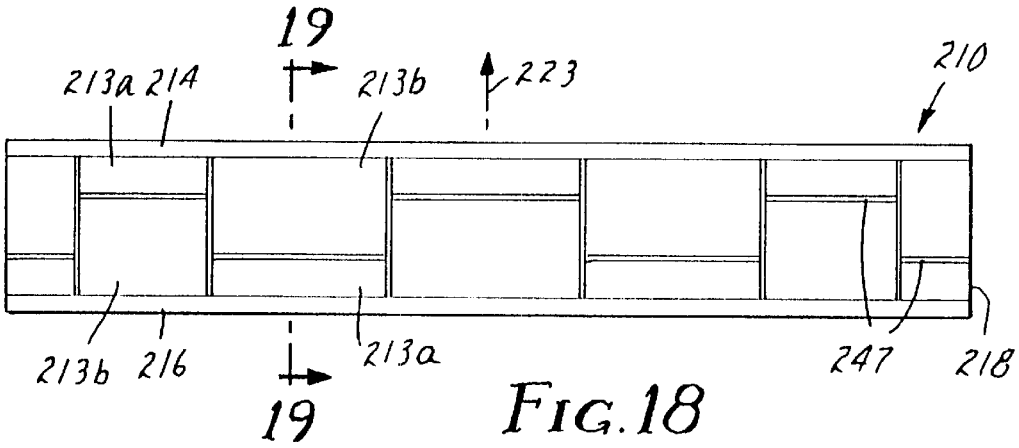
FIG. 18 is a front view of a third embodiment of an abrasive grinding wheel including stacked abrasive segments in accordance with the present invention.

FIG. 18 shows an alternate embodiment of the present invention. Elements in FIG. 18 functionally similar to those of FIGS. 1 and 2 are shown with like numerals incremented by 200. FIG. 18 shows wheel 210 having stacked abrasive segments 213*a* and 213*b* between upper and lower support plates 214 and 216, respectively. By stacking abrasive segments 213*a* and 213*b*, an axially thicker abrasive wheel can be formed, However, so stacking segments 213*a* and 213*b* can cause grooves 247 to form therebetween. To reduce the chances of grooves 247 forming a raised lip in a workpiece, segments 213*a* and 213*b* can be stacked, with narrow segments 213*a* alternating positions with thicker segments 213*b* between circumferentially adjacent segments. In this way grooves 247 are staggered in an axial direction around the circumference of abrasive surface 218. By axially staggering grooves 247, the likelihood of the grooves contacting a workpiece for an entire rotation of wheel 210 is reduced, thus reducing the chances of forming a raised lip on a workpiece surface. Wheel 210 can be fabricated in substantially the same manner as wheel 110.

Figure 19:
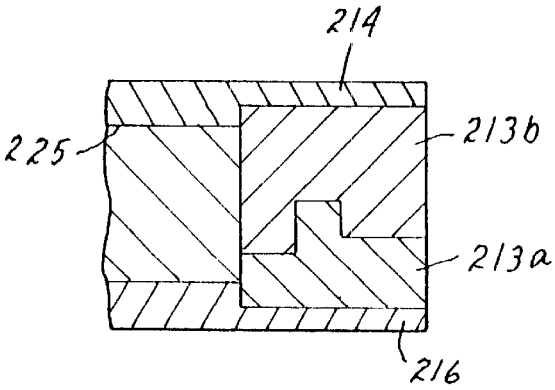
FIG. 19 is a cross-sectional view of the grinding wheel shown in FIG. 18 taken along section line 19—19 of FIG. 18.

FIG. 19 is a sectional view of wheel 210 taken along line 19—19 of FIG. 18. FIG. 19 shows one possible configuration for vertically stacking abrasive segments 213*a* and 213*b*. As shown, abrasive segments 213*a* and 213*b* are splined together. Splining together abrasive segments 213*a* and 213*b* as shown has the advantage of providing for a more secure attachment of segments 213*a* and 213*b* to support plates 214 and 216. It is also contemplated that abrasive segments 213*a* and 213*b* be splined together in any other configuration. It is also contemplated that segments 213*a* and 213*b* meet only at a butt-joint without any splines.

Figure 20:
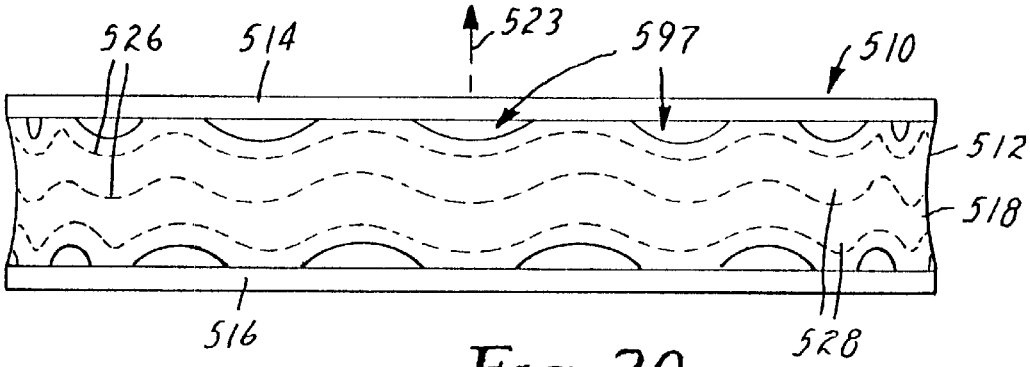
FIG. 20 is a front view of another embodiment of an abrasive grinding wheel in accordance with the present invention having an abrasive surface with the axial position of the abrasive particle layers varying.

FIG. 20 is a front view of another embodiment of a grinding wheel in accordance with the present invention. In the embodiment of FIG. 20, wheel 510 includes an abrasive region 512 preferably sandwiched between a first support plate 514 and a second support plate 516, but need not be. Abrasive region 512 includes an outer abrasive surface 518 which can be a substantially cylindrical band that extends around the perimeter of abrasive grinding wheel 510. Wheel 510 has an axis of rotation 523.

Like abrasive region 12 of wheel 10, abrasive region 512 is made up hard or abrasive particle layers 526, represented by dashed lines, surrounded by bond material regions 528. However, the abrasive particle layers 526 are not substantially planer, rather, they can be configured to have a sinusoidal-like exposed edge along abrasive surface 518. In this way, abrasive surface 518, when rotated about axis of rotation 523, will sweep an edge of an abrasive particle layer 526 across an axial distance greater than the axial thickness of the edge at any given point on the edge. Also, at least one path defined by the intersection of a plane perpendicular to the axis of rotation and the abrasive surface will intersect at least one layer of abrasive particles in at least three locations. Further, in the embodiment shown in FIG. 20, the distance in the axial direction between two adjacent abrasive particle layers can remain substantially constant around the perimeter of wheel 510, but need not.

Additionally, the peaks of any first abrasive particle layer edge can extend to a point axially level with or above the troughs of an another abrasive particle layer edge adjacent to and above the first abrasive particle layer edge. In this way, any path defined by the intersection of a plane perpendicular to the axis of rotation of wheel 510 an a complete circumference of abrasive region 512 will intersect or cut across at least one abrasive particle layer 526. It is also contemplated that abrasive particle layers 526 have edges which form other configurations such as sawtooth waves or irregular smooth waves.

To form wheel 510 having edges of abrasive particle layer 526 which undulate in a waveform as shown in FIG. 20, the layers which comprise the abrasive region 512, that is bond layers 50–54, hard or abrasive particle layers 70–74, and if desired, porous material layers 60–64 and adhesive layers 80–84, are preferably stacked and sintered in a single sintering step with support plates 514 and 516. Such a sintering process can be substantially the same sintering process as that used to form laminated sheet 51, however, support plates 514 and 516 would be stacked above and below, respectively, the layers forming abrasive region 512.

However, support plates 514 and 516 do not need to have interior faces angled with respect to a plane parallel to the axis of rotation 523 of wheel 10. Also, to create the undulations, spacers 597 are preferably circumferentially spaced between the layers forming abrasive region 512 and first support 514 and between the layers forming abrasive region 512 and second support plate 516. The position of spacers 597 that are adjacent to first support plate 514 can be circumferentially shifted from the position of spacers 597 that are adjacent to second support plate 516.

Figure 21:
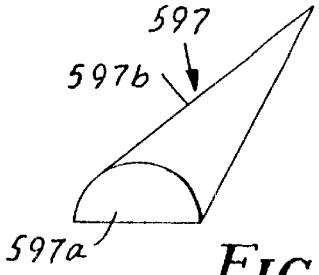
FIG. 21 is a perspective view of a spacer which can be used to fabricate the grinding wheel shown in FIG. 20.

One embodiment of spacers 597 is shown in a perspective view in FIG. 21. As shown, spacer 597 is preferably conical and wedge shaped having a front face 597*a* and a tapering tail 597*b*. Only front face 597*a* is visible in FIG. 20. Spacers 597 can be formed from any substantially rigid material such as steel, aluminum, or bronze. Because the layers of abrasive region 512 are each flexible, each layer can be formed to smoothly pass over or under spacers 597 such that when the layers of material forming the abrasive region 512 are sandwiched with spacers 597 between support plates 514 and 516, the sinusoidal-like undulations are formed in the layers of material forming the abrasive region 512, including the abrasive particle layers 526. It is also contemplated to form spacers 597 in other configurations such as rectangular, prism shaped, cylindrical, or semi-cylindrical. After sintering, wheel 510 can be mounted on a rotating shaft in substantially the same manner as wheel 10.

Figure 22:
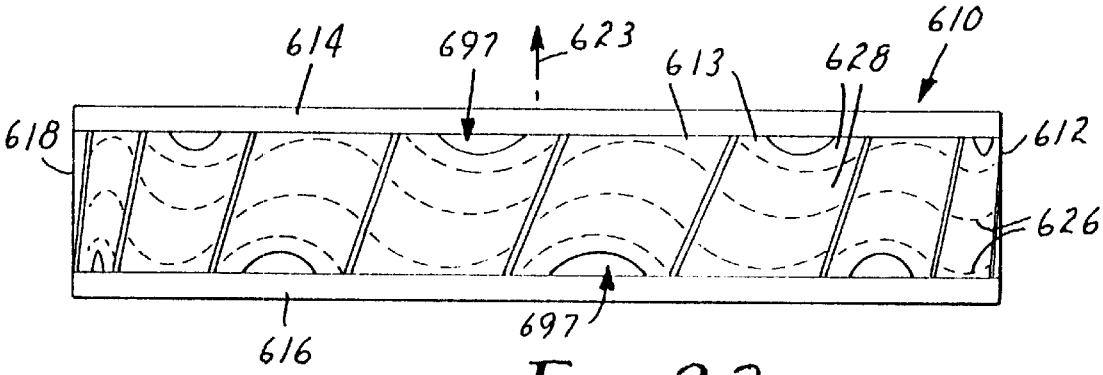
FIG. 22 is a front view of another embodiment of an abrasive grinding wheel in accordance with the present invention having an abrasive surface formed from abrasive segments.

FIG. 22 is a front view of still another embodiment of an abrasive grinding wheel in accordance with the present invention. In the embodiment of FIG. 22, wheel 610 includes an abrasive region 612 preferably sandwiched between a first support plate 614 and a second support plate 616. Abrasive region 612 includes an outer abrasive surface 618 which can be a substantially cylindrical band that extends around the perimeter of abrasive grinding wheel 610. Wheel 610 has an axis of rotation 623.

Like abrasive region 512 of wheel 510, abrasive region 612 is made up hard or abrasive particle layers 626, represented by dashed lines, surrounded by bond material regions 628. Further, the edges of abrasive particle layers 626 undulate in a sinusoidal-like form like edges of abrasive particle layers 526 so that at least one edge of an abrasive particle layer intersects in at least two locations at least one path defined by the intersection of a plane perpendicular to the axis of rotation and the abrasive surface. However, abrasive region 612 is formed from abrasive segments 613 like abrasive segments 113 of wheel 110. Each segment 613 has abrasive particle layers 626 which curve or undulate in a sinusoidal-like form. Further, like wheel 510, the peaks of any first abrasive particle layer edge will extend to a point axially level with or above the troughs of an another abrasive particle layer edge adjacent to and above the first abrasive particle layer edge. Accordingly, like wheel 510, any path defined by the intersection of a plane perpendicular to the axis of rotation of wheel 510 an a complete circumference of abrasive region 512 will intersect or cut across at least one abrasive particle layer 526. It is also contemplated that abrasive particle layers 626 have edges which form other configurations such as sawtooth waves or irregular smooth waves.

Wheel 610 can be formed in substantially the same manner as wheel 110 with the exception that when forming a laminated sheet such as sheet 51 from which segments 613 are cut, spacers 697, which can be substantially the same as spacers 597, are placed between the layers forming the laminated sheet and top punch, such as punch 84, and between the layers forming the laminated sheet and a bottom punch, such as punch 85. Spacers 697 are circumferentially spaced in a circular configuration like the spacers used to form wheel 510. Also, spacers 697 adjacent to the top punch are circumferentially shifted with respect to the spacers adjacent to the bottom punch. The layers used to form the laminated sheet are then sintered together with the spacers. Abrasive segments 613 can then be cut from the resulting laminated sheet as shown in FIG. 7.

Figure 23:
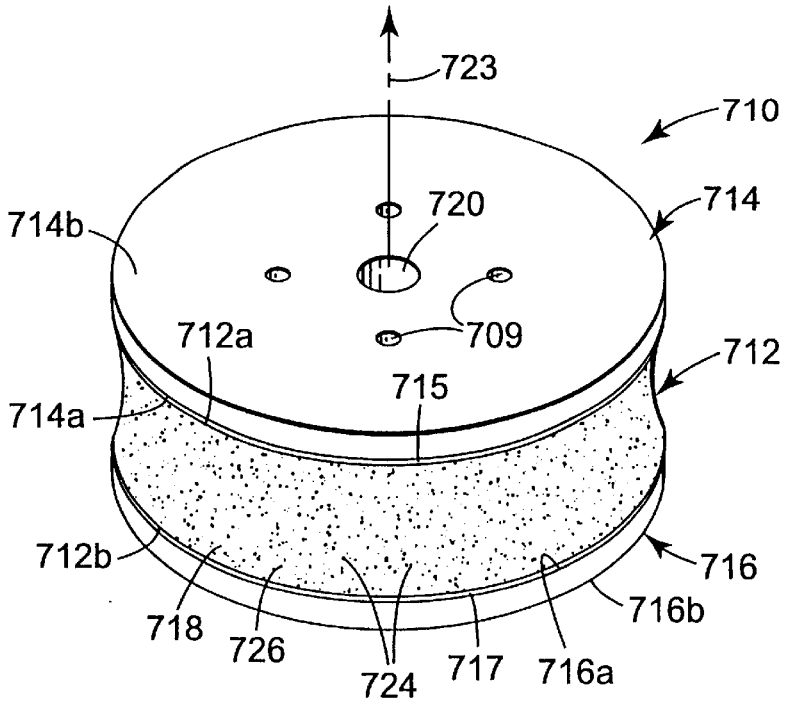
FIG. 23 is a front view of another embodiment of an abrasive grinding wheel in accordance with the present invention having an abrasive layer which is adhesively bonded to the support plates.
Figure 24:
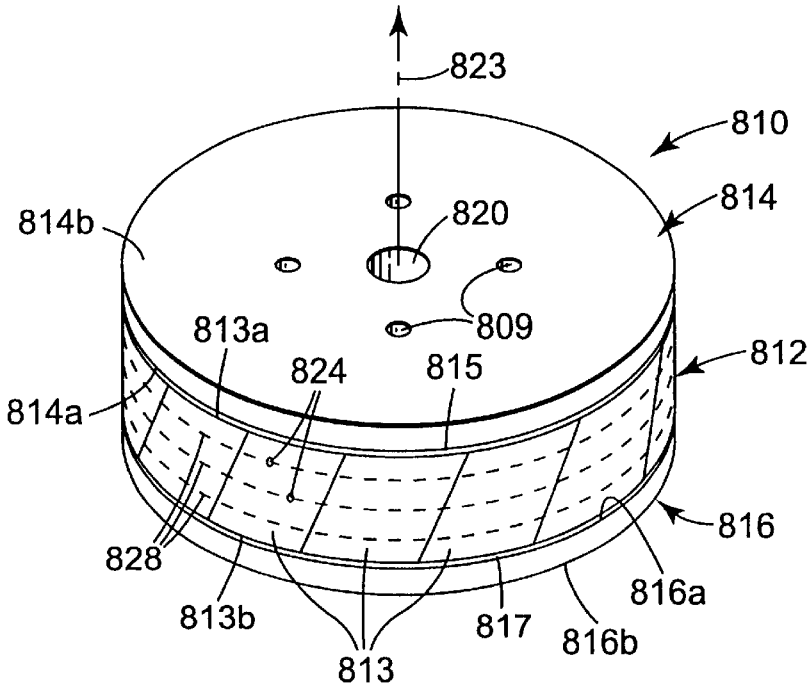
FIG. 24 is a front view of another embodiment of an abrasive grinding wheel in accordance with the present invention having an abrasive layer which formed from a plurality of abrasive segments which are adhesively bonded to the support plates.

The present invention also provides abrasive grinding wheels and a method for making abrasive grinding wheels in which the abrasive layer is adhesively bonded to one or more support plates. Various embodiments of adhesively bonded grinding wheels are shown in FIGS. 23–25. Like elements are labeled with like numbers throughout FIGS. 23–25.

Referring now to FIG. 23 a first embodiment of an adhesively bonded abrasive grinding wheel is shown. Grinding wheel 710 includes first support plate 714 (having inner major surface 714*a* and outer major surface 714*b*), second support plate 716 (having inner major surface 716*a* and outer major surface 716*b*), metal bond abrasive layer 712 (having first major surface 712*a* and second major surface 712*b*), first adhesive layer 715, and second adhesive layer 717. Metal bond abrasive layer 712 is a single (i.e., continuous) mass of metal bond abrasive and is interposed between first adhesive layer 715 and second adhesive layer 717. First adhesive layer 715 bonds the first major surface 712*a* of abrasive layer 712 to the inner major surface 714*a* of first support plate 714. Likewise, second adhesive layer 717 bonds the second major surface 712*b* of abrasive layer 712 to the inner major surface 716*a* of second support plate 716. Grinding wheel 710 is generally cylindrical and has bore 720 passing through a top and bottom face thereof. Wheel 710, via bore 720, can be mounted on a rotatable shaft (not shown) and rotated about axis of rotation 723. It is also contemplated to attach wheel 710 to a rotatable shaft by attaching a mounting plate (not shown) having a central shaft (not shown) to the wheel using mounting holes 709. It is to be understood, however, that mounting holes 709 are not necessary. By rotating wheel 710 on or by a rotatable shaft, a workpiece can be held against the abrasive surface 718 of wheel 710 so that the workpiece can be shaped, ground, or cut. Metal bond abrasive layer 712 has a substantially cylindrical abrasive surface 718 extending around a perimeter surface of wheel 710. Abrasive surface 718 may have any desired grinding profile. In a preferred embodiment, the grinding profile of abrasive surface 718 is concave which allows grinding wheel 710 to impart a rounded edge to a workpiece. Metal bond abrasive layer 712 may have ordered layers (e.g., planar layers, sinusoidal layers) of abrasive particles as described herein or the abrasive layer may have abrasive particles randomly distributed throughout the metal bond material. In FIG. 23, abrasive layer 712 is shown having abrasive particles 724 randomly distributed throughout bond material 726. The abrasive particles 724 may be formed from any relatively hard substance including superabrasive particles such as diamond, cubic boron nitride, boron suboxide, boron carbide, silicon carbide and mixtures thereof.

Referring now to FIG. 24 a second embodiment of an adhesively bonded grinding wheel of the present invention is shown. Grinding wheel 810 includes first support plate 814 (having inner major surface 814*a* and outer major surface 814*b*), second support plate 816 (having inner major surface 816*a* and outer major surface 816*b*), metal bond abrasive layer 812, first adhesive layer 815, and second adhesive layer 817. Like wheel 710, wheel 810 via bore 820 and optional mounting holes 809 can be mounted on a rotatable shaft (not shown) and rotated about axis of rotation 823. Metal bond abrasive layer 812 is made up of a plurality of discrete metal bond abrasive segments 813 which are circumferentially spaced about the perimeter of wheel 810. The abrasive segments 813 each have first major surface 813*a* and second major surface 813*b*. The metal bond abrasive segments 813 are interposed between first adhesive layer 815 and second adhesive layer 817. First adhesive layer 815 bonds the first major surfaces 813*a* of metal bond abrasive segments 813 to the inner major surface 814*a* of first support plate 814. Likewise, second adhesive layer 817 bonds the second major surfaces 813*b* of metal bond abrasive segments 813 to the inner major surface 816*a* of second support plate 816. Metal bond abrasive layer 812 may have ordered layers (e.g., substantially planar, parallel layers, or sinusoidal layers) of abrasive particles or randomly distributed abrasive particles (see, for example, FIG. 23). It is also within the scope of the present invention to include both abrasive segments having ordered layers of abrasive particles and abrasive segments having randomly distributed abrasive particles in the same grinding wheel. In FIG. 24, the abrasive segments 813 are shown having abrasive particles 824 distributed throughout the bond material in substantially planar, parallel layers 828 (represented with dashed lines in FIG. 24).

Figure 25A:
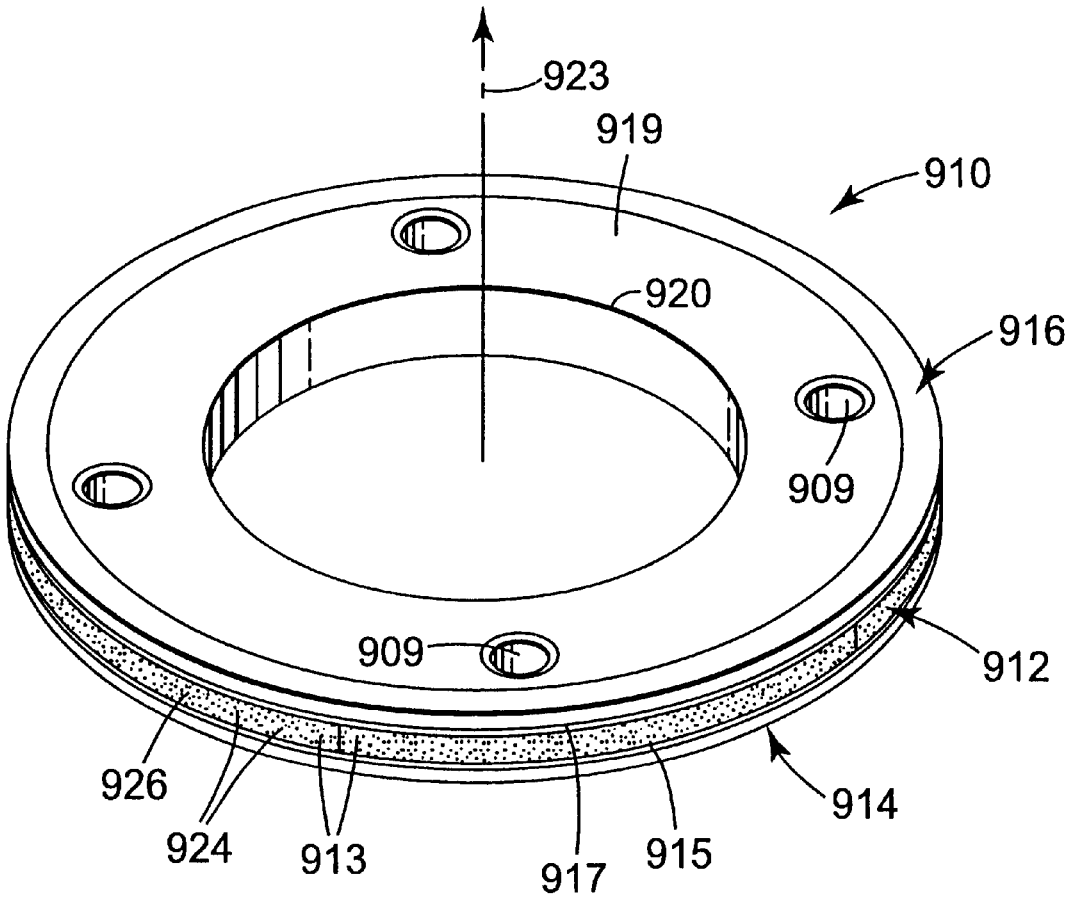
FIG. 25*a* is a front view of another embodiment of an abrasive grinding wheel in accordance with the present invention having an abrasive layer which formed from a plurality of abrasive segments which are adhesively bonded to the support plates.
Figure 25B:
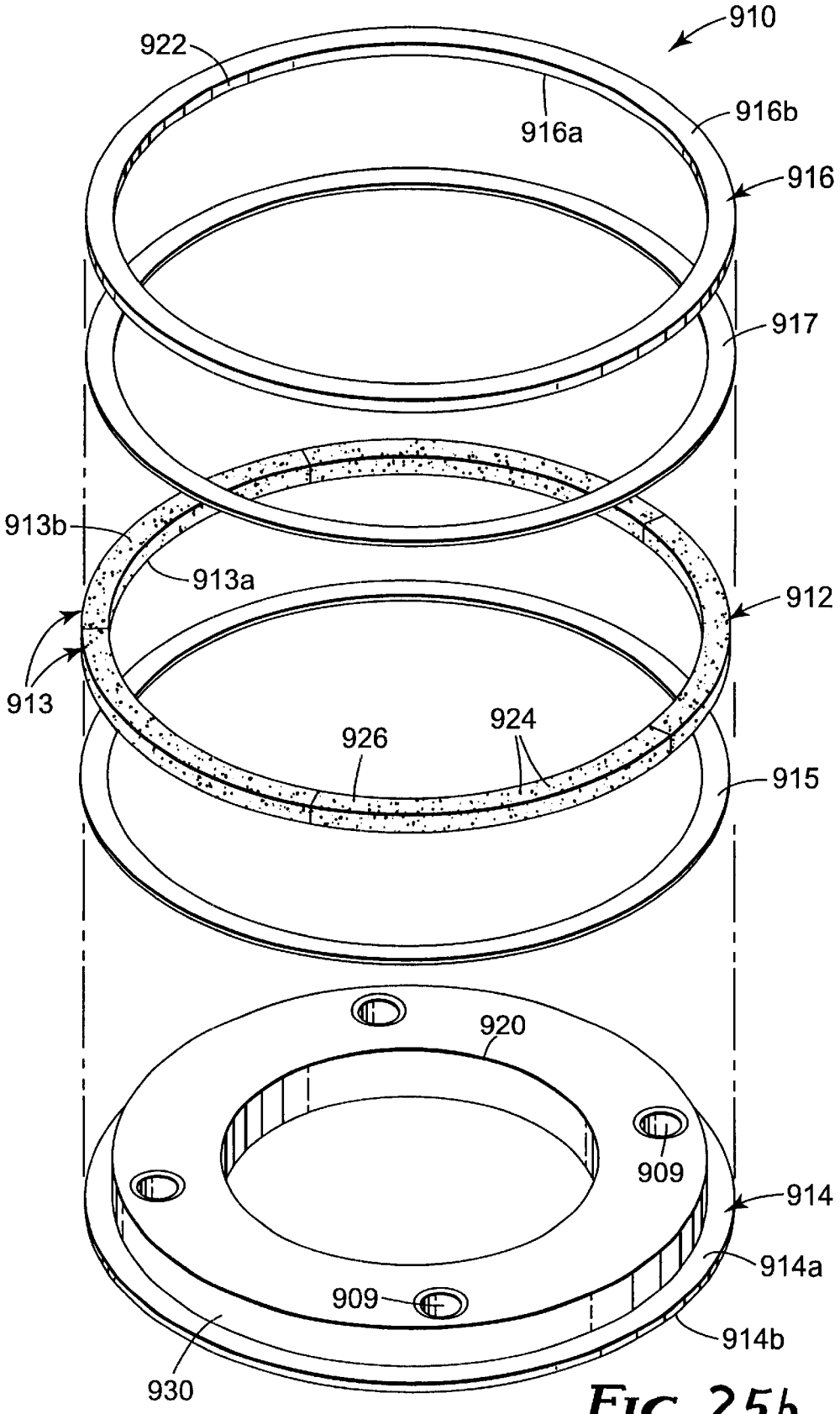
FIG. 25*b* is an assembly view of the embodiment of FIG. 25*a*.

Referring now to FIGS. 25*a* and 25*b*, a third embodiment of an adhesively bonded grinding wheel of the present invention is shown. Grinding wheel 910 includes first support plate 914 (having inner major surface 914*a* and outer major surface 914*b*), second support plate 916 (having inner major surface 916*a* and outer major surface 916*b*), abrasive layer 912, first adhesive layer 915, and second adhesive layer 917. Like wheel 710, wheel 910 via bore 920 and optional mounting holes 909 can be mounted on a rotatable shaft (not shown) and rotated about axis of rotation 923. As shown in FIG. 25*b*, first support plate 914 includes axially extending surface 930. Second support plate 916 has inner circular opening 922 which mates with first support plate 914 over axially extending surface 930. Abrasive layer 912 is made up of a plurality of discrete metal bond abrasive segments 913 which are circumferentially spaced about the perimeter of grinding wheel 910. The abrasive segments 913 each have a first major surface 913*a* and a second major surface 913*b*. Metal bond abrasive segments 913 are interposed between first adhesive layer 915 and the second adhesive layer 917. First adhesive layer 915 bonds the first major surfaces 913*a* of metal bond abrasive segments 913 to inner major surface 914*a* of first support plate 914. Likewise, second adhesive layer 917 bonds the second major surfaces 913*b* of metal bond abrasive segments 913 to inner major surface 916*a* of second support plate 916. Optionally, adhesive may be applied to axial surface 930 to further bond the metal bond abrasive segments 913 to first support plate 914. Metal bond abrasive segments 913 may have ordered layers (e.g., substantially planar, parallel layers or sinusoidal layers) of abrasive particles or randomly distributed abrasive particles. It is also within the scope of the invention to include both abrasive segments having ordered layers of abrasive particles and abrasive segments having randomly distributed abrasive particles in the same grinding wheel. In FIGS. 25*a* and 25*b*, abrasive layer 912 is shown having abrasive particles 924 randomly distributed throughout bond material 926.

Suitable adhesives for bonding the abrasive layer to the support plate(s) include those adhesives which have sufficient strength to bond the abrasive layer to the support plate(s) under typical use conditions for a grinding wheel. That is, the adhesive must hold the abrasive layer against the forces generated during the abrading operation. Primarily, this includes shear force(s) generated by the rotation of the grinding wheel about its axis and shear force(s) generated by contact between the abrasive layer and the workpiece.

A preferred class of adhesives may be described as structural adhesives in that they are capable of forming a bond between two materials wherein the bond has high shear and peel strength. Examples of the types of adhesives which may be suitable include one-part thermosetting adhesives, two-part thermosetting adhesives (e.g., two-part epoxies), acrylics, urethanes, pressure sensitive adhesives, hot melt adhesives, moisture curing adhesives, and the like. Such adhesives may be provided as liquids, solids, powders, pastes, films, and may be thermally cured, dried, reactive mixtures and the like. The adhesive may be applied over the entire area of contact between the metal bond abrasive layer and the support plate(s) or the adhesive may be applied to only a portion of the contact area. It should be understood that the selection of a suitable adhesive for bonding the metal bond abrasive layer to the support plate(s) may be dependent upon factors such as the diameter of the grinding wheel, the mass of the abrasive layer or abrasive segments, the surface area of adhesive, the rotational speed of the grinding wheel. For example, as the maximum rotational speed of the grinding wheel is increased, the strength of the adhesive bond must be increased to counteract the shear force(s) (e.g., centripetal force) acting on the abrasive layer. Similarly, as the bonding area between the abrasive layer and the support plate is decreased, the strength of the adhesive bond must be increased to counteract the increased unit force(s).

Similarly, it should be recognized that changes in the diameter of the wheel require changes in the adhesive strength necessary to hold the wheel together. By way of example, for a 6 inch (15.24 cm) grinding wheel with segments having a mass of 0.110 lbs (0.05 kg) and a bonding area of 2 square inches, an adhesive shear strength of about 42 psi is required at about 3000 rpm and an adhesive shear strength of about 168 psi is required at about 6000 rpm. Following the same as above, for a 10 inch (25.4 cm) grinding wheel with segments having a mass of 0.110 lbs (0.05 kg) and a bonding area of 2 square inches, an adhesive shear strength of about 70 psi is required at about 3000 rpm and an adhesive shear strength of about 279 psi is required at about 6000 rpm.

Typically, it is desirable to exceed, preferably substantially exceed, the required adhesive shear strength. To this end, preferred adhesives may be described as structural adhesives in that they form high strength (e.g., high shear and peel strength) and load bearing adhesive bonds. Suitable adhesives typically provide a shear strength of at least about 6.89 MPa (1000 psi), preferably at least about 10.34 MPa (1500 psi), more preferably at least about 13.79 MPa (2000 psi), and most preferably at least about 27.58 MPa (4000 psi).

A particularly suitable class of adhesives is thermosetting structural adhesives which are heat cured to provide a structural bond. A commercially available thermosetting structural adhesive is available under the trade designation "SCOTCH-WELD" and is identified as Structural Adhesive Film AF-30 (commercially available from Minnesota Mining and Manufacturing Company, St. Paul, Minn.). Another suitable structural adhesive is an acrylic-epoxy adhesive identified as Structural Bonding Tape 9244 (commercially available from Minnesota Mining and Manufacturing Company, St. Paul, Minn.).

Support plates suitable for use in adhesively bonded abrasive grinding wheels of the present invention may be made of any suitable substantially rigid material. Preferably, the support plates are made of metal, for example, steel, aluminum, brass, or titanium. Most preferably, the support plates are made of aluminum to reduce the overall weight of the grinding wheel. Support plates made of polymeric materials and fiber reinforced polymeric materials may also be used. It should be recognized that the adhesives selected, while dependent on strength properties required for this application, are also selected based on the surface material being bonded. Adhesives used to bond abrasive bodies to steel support plates may be different than those selected to bond to aluminum support plates.

Bonding of the metal bond abrasive segments to the support plate may be improved by surface treating the support plate(s) and/or the metal bond abrasive layer prior to forming the adhesive bond. Surface treating techniques include, for example, abrasive surface conditioning (e.g., sandblasting), solvent cleaning, acid or base treatment, and chemical priming. A suitable chemical primer is commercially available under the trade designation "Primer EC1660" (available from Minnesota Mining and Manufacturing Company, St. Paul, Minn.). Bonding may also be improved by axially compressing the grinding wheel assembly (e.g., using a platen press) while curing the adhesive. In the case of thermosetting adhesives, it may be desirable to heat the platen press in order to cure the adhesive while under compression.

EXAMPLES

Example 1

The following procedure was used to form an abrasive wheel in accordance with the present invention.

Two steel plates were machined such that the total dimensions of the plates were 25.4 cm by 25.4 cm by 0.476 cm thick (10 inches by 10 inches by 3/16 inch thick) with a one sided taper of 0.150 degrees. Between these two steel plates (tapered side in and opposite), 34 alternating layers of metal tape and patterned diamond abrasive cut to 25.4 cm (10 inch) nominal squares were aligned.

The metal tape layers consisted of a 1:1 ratio of bronze to cobalt, with the addition of a small amount of low temperature braze, and a few organic binders to allow the tape to be handleable. The composition of the slurry used to make the metal tape layer was specifically as shown in the chart below, the values representing percent by weight of the substance.

| | |
|---|---|
| 38.28 | cobalt |
| 38.28 | bronze |
| 2.38 | nickel |
| 0.195 | chromium |
| 0.195 | phosphorous |
| 17.74 | 1.5/1 MEK/toluene |
| 1.387 | polyvinyl butyral |
| 0.527 | polyethylene glycol having a molecular weight of about 200 |
| 0.877 | dioctylphthalate |
| 0.132 | corn oil |

These tapes were cast so that the area density was roughly 0.15 gram/cm$^2$ (1 gram/inch$^2$) when dry.

To form the diamond abrasive particle layers, a pressure sensitive adhesive commercially available from Minnesota Mining and Manufacturing Company (St. Paul, Minn.) under the trade designation "SCOTCH" brand adhesive tape was placed on one side of an open mesh screen having approximately 107 $\mu$m openings, 165 openings per square inch, and made from 0.48 mm diameter stainless wire. Diamond abrasive particles of approximately 170/200 mesh were dropped onto the screen openings in a 20.32 cm (8 inch) radial ring pattern so that the diamonds adhered to the tape. This resulted in diamond particles occupying the majority of the screen openings. Once the radial pattern of diamonds was applied, small steel shot was used to fill in all remaining exposed area.

The screens, filled with abrasive particles, and flexible sheets of metal powder were stacked upon each other to form a laminar composite. After layering the metal tape and abrasive layers between the plates, the part was sintered as shown in the following table:

| Time (sec.) | Temp. (° C.) | Pressure (kg/cm$^2$) |
|---|---|---|
| 0 | 20 | 0 |
| 550 | 420 | 100 |
| 730 | 420 | 100 |
| 950 | 550 | 100 |
| 1030 | 550 | 100 |
| 1210 | 590 | 100 |
| 1240 | 590 | 100 |
| 1980 | 890 | 100 |
| 2400 | 890 | 100 |
| 2410 | 895 | 250 |
| 2520 | 895 | 250 |
| 2860 | 895 | 350 |
| 500 | 20 | 350 |

Once the final part had cooled, the 25.4 cm by 25.4 cm plate was machined to extract the diamond abrasive region in the form of a round wheel. This wheel was then balanced, trued and dressed to the final 20.32 cm (8 inch) diameter. Appropriate mounting holes were also introduced.

Though the present invention has been described with the reference to preferred embodiments, those skilled in the art will recognize that changes can be made in form and detail without departing from the spirit and scope of the invention.

Example 2

The following procedure was used to form an abrasive wheel in accordance with the present invention.

Fifty-five alternating layers of metal tape and patterned diamond abrasive cut into 5 inch nominal squares were stacked and aligned. These layers were then cold compacted to produce a green structure, ready of sintering.

The metal tape layers consisted of iron/copper diamond setting powders, with the addition of a small amount of low temperature braze, and a few organic binders to allow the tape to be handleable. The composition of the slurry used to make the metal tape layer was specifically as shown in the chart below, the values representing percent by weight of the substance.

| | |
|---|---|
| copper | 33.7 |
| iron | 27.5 |
| nickel | 7.87 |
| tin | 3.41 |
| chromium | 2.43 |
| boron | 0.34 |

-continued

| | |
|---|---|
| silica | 0.44 |
| tungsten carbide | 9.38 |
| cobalt | 0.67 |
| phosphorus | 0.17 |
| Methyl Ethyl Ketone | 12.6 |
| polyvinyl butyral | 0.89 |
| Santicizer 160[1] | 0.62 |

[1]Santicizer 160 is commercially available from Solutia Inc., St. Louis MO.

These tapes were cast so that the area density was on average 0.65 gram/inch$^2$ when dry.

To form the diamond abrasive particle layers, a pressure sensitive adhesive commercially available from Minnesota Mining and Manufacturing Company (St. Paul, Minn.) under the trade designation "SCOTCH" brand adhesive tape designated as book Tape #845 was placed on one side of an open mesh screen having approximately 107 $\mu$m openings, 165 openings per square inch, and made from 0.48 mm diameter stainless wire. Diamond abrasive particles of approximately 200/230 mesh were dropped onto the screen such that one diamond was in each opening of the 5 inch square layer. This resulted in diamond particles occupying the majority of the screen openings.

The screens, filled with abrasive particles, and flexible sheets of metal powder were stacked upon each other to form a laminar composite. After layering the metal tape and abrasive layers between the plates, the part was sintered as shown in the following table:

| Time (sec.) | Temp. (° C.) | Pressure (kg/cm$^2$) |
|---|---|---|
| 0 | 20 | 0 |
| 550 | 420 | 100 |
| 730 | 420 | 100 |
| 950 | 550 | 100 |
| 1130 | 550 | 100 |
| 1210 | 590 | 100 |
| 1240 | 590 | 100 |
| 1750 | 880 | 200 |
| 2110 | 880 | 200 |
| 2430 | 1007 | 200 |
| 2790 | 1007 | 200 |
| 2970 | 870 | 250 |
| 3330 | 850 | 400 |

Once the final part had cooled, the metal bond abrasive was converted into are shaped metal bond abrasive segments by means of abrasive water jet cutting.

These metal bond abrasive segments were then bonded to two aluminum support plates using a structural adhesive. The support plates and segments were cleaned and treated to provide an adequate surface for bonding. In the case of the aluminum support plates, the bonding surfaces were cleaned with MEK, acid etched, and primed. The acid etching of the aluminum support plates comprised several steps. First, the support plates were dipped in an alkaline wash for 10 minutes at 88° C. The alkaline wash was made up of approximately 9–11 ounces per gallon of Oakite 164 (commercially available from Oakite Products, Inc., Berkeley Hgts., N.J.) After a thorough rinse with water, they were acid etched for 10 minutes at 71° C. in a sulfuric acid mixture. After rinsing with water, the support plates were allowed to air dry for 10 minutes on a tilted rack and were then oven dried for an additional 10 minutes at 71° C.

The surface priming was performed by brushing a thin layer of EC1660 primer (commercially available from Minnesota Mining and Manufacturing Company, St. Paul, Minn.) onto the bonding surfaces. The primer was allowed to dry in accordance with the manufacturer's recommended conditions.

In the case of the metal bond abrasive segments, the bonding surfaces were sandblasted, solvent washed with methyl-ethyl ketone, and surface primed. The sandblasting process was performed using 80 grit aluminum oxide at approximately 60 psi pressure. The surface priming was performed by brushing a thin layer of EC1660 primer onto the bonding surfaces. The primer was allowed to dry in accordance with the manufacturer's recommended conditions.

After the surface preparation was complete, a 10 mil layer of a structural adhesive (commercially available from Minnesota Mining and Manufacturing Company, St. Paul, Minn. under the trade designation "AF30") was placed onto the first bonding surface of the support plate. The arc-shaped metal bond abrasive segments were then placed onto the adhesive surface creating a cylindrical region of abrasive around the center of the support plate. The segments were then covered with a second layer of structural adhesive of the same type. A second aluminum support plate was then placed over the second layer of structural adhesive thereby forming a grinding wheel assembly (see, FIG. 25*b*).

The grinding wheel assembly was then placed into a heated platen press to cure the thermosetting adhesive in order to form bonds between the abrasive segments and the support plates. The wheel assembly was then heated from 38° C. to 177° C. at a rate of 5.6° C./minute under a constant pressure of 689 KPa. After holding at 177° C. for one hour, the grinding wheel assembly was cooled to room temperature under the same applied pressure.

The resulting abrasive grinding wheel was then balanced, trued and dressed to the final 20.32 cm (8 inch) diameter.

Though the present invention has been described with reference to preferred embodiments, those skilled in the art will recognize that changes can be made in form and detail without departing from the spirit and scope of the invention.

What is claimed is:

1. An abrasive grinding wheel that can be rotated about an axis of rotation, the abrasive grinding wheel comprising:

a means for defining an axis of rotation of the abrasive grinding wheel;

a substantially cylindrical region of abrasive material having a circumferentially extending abrasive surface at a peripheral band thereof and formed from a plurality of layers of abrasive particles, each layer of abrasive particles separated from an adjacent layer of abrasive particles by a layer of bond material, and each layer of abrasive particles extending along at least a portion of the circumference of the abrasive surface and in a radial direction of the substantially cylindrical region of abrasive material from the abrasive surface toward the axis of rotation; and wherein any circular path defined by an intersection of a plane perpendicular to the axis of rotation of the abrasive grinding wheel and a complete circumference of the abrasive surface will intersect at least one of the plurality of layers of abrasive particles.

2. The abrasive grinding wheel of claim 1 wherein the plurality of layers of abrasive particles are substantially planar and parallel to one another.

3. The abrasive grinding wheel of claim 1 including a first support plate and a second support plate, and wherein the region of abrasive material is sandwiched between the first support plate and the second support plate.

4. The abrasive grinding wheel of claim 3 wherein the abrasive material is bonded to the first and the second support plates with an adhesive.

5. The abrasive grinding wheel of claim 3 wherein a plane substantially parallel with the layers of abrasive particles forms an angle of between 0 degrees and 180 degrees, exclusive, with the axis of rotation of the abrasive grinding wheel.

6. The abrasive grinding wheel of claim 5 wherein the region of abrasive material includes a first surface and a second surface which is substantially parallel to the first surface, and wherein both the first surface and the second surface are tilted at an angle of between 0 degrees and 90 degrees, exclusive, with the axis of rotation of the abrasive grinding wheel.

7. The abrasive grinding wheel of claim 1 wherein at least a first layer of abrasive particles of the plurality of layers of abrasive particles extends along the abrasive surface such that at least one path defined by the intersection of a plane perpendicular to the axis of rotation and the abrasive surface will intersect the first layer of abrasive particles in at least three locations.

8. The abrasive grinding wheel of claim 1 further including:

first and second support plates forming outer axial surfaces of the grinding wheel; and a plurality of discrete abrasive segments circumferentially spaced between the first and second support plates to form the region of abrasive material, each abrasive segment having a plurality of layers of abrasive particles.

9. The abrasive grinding wheel of claim 8 wherein the abrasive segments are bonded to the first and the second support plates with an adhesive.

10. The abrasive grinding wheel of claim 8 wherein at least one of the plurality of layers of abrasive particles in at least one of the plurality of abrasive segments are offset in an axial direction from at least one of the plurality of layers of abrasive particles in at least one other of the plurality of abrasive segments.

11. The abrasive grinding wheel of claim 10 wherein the plurality of layers of abrasive particles in each of the plurality of abrasive segments is oriented to extend substantially perpendicular to the axis of rotation of the abrasive grinding wheel.

12. The abrasive grinding wheel of claim 10 wherein at least one of the plurality of layers of abrasive particles in each of the plurality of abrasive segments is separated from an adjacent layer of abrasive particles in a same segment by a separation distance perpendicular to each layer of abrasive particles and further wherein at least one separation distance in at least one of the plurality of abrasive segments is different from at least one separation distance in at least one other of the plurality of abrasive segments.

13. The abrasive grinding wheel of claim 8 further including:

at least one opening provided in the abrasive surface;

a first channel positioned radially interior to the abrasive surface and in fluid communication with the opening;

a second channel opening to the interior of the abrasive grinding wheel and located in a center region thereof; and at least one radial channel extending from the second channel of the abrasive grinding wheel to the first channel and in fluid communication with both the first channel and the second channel;

so that a liquid lubricant provided under pressure to first channel can pass through the radial channel, into the circular channel and through the opening to lubricate the abrasive surface of the grinding wheel during rotation of the grinding wheel.

14. The abrasive grinding wheel of claim 8 wherein an abrasive segment that extends over a circumferential portion of the abrasive surface is made up of plural axial segments that are stacked adjacent to one another in the axial direction of the grinding wheel and supplied between the first and second support plates.

15. The abrasive grinding wheel of claim 8 wherein at least a first abrasive particle layer of the plurality if abrasive particle layers in at least one abrasive segment of the plurality of abrasive segments intersects in at least two locations a path defined by the intersection of a plane perpendicular to the axis of rotation and the abrasive surface.

16. The abrasive grinding wheel of claim 1 wherein the abrasive surface includes a grinding profile which is convex.

17. The abrasive grinding wheel of claim 1 wherein the abrasive surface includes a grinding profile which is concave.

18. An abrasive grinding wheel for connection to a rotary tool so that the abrasive grinding wheel can be rotated about an axis of rotation, comprising:

a means for defining an axis of rotation of the abrasive grinding wheel;

a substantially cylindrical abrasive region having layers of abrasive particles, each layer of abrasive particles separated from an adjacent layer of abrasive particles by a layer of bond material, and each layer of abrasive particles extending along at least a portion of the circumference of the abrasive surface and in at least a radial direction of the substantially cylindrical region of abrasive material, and wherein the plurality of layers of abrasive particles form an angle of between 0 degrees and 180 degrees, exclusive, with the axis of rotation of the abrasive grinding wheel.

19. The abrasive grinding wheel of claim 18 wherein the abrasive region includes a first surface and a second surface, both the first surface and the second surface being substantially parallel to the plurality of layers of abrasive particles, both the first and second surfaces further being tilted at an angle of between 0 degrees and 90 degrees, exclusive, with the axis of rotation of the abrasive grinding wheel.

20. The abrasive grinding wheel of claim 19 including a first support plate and a second support plate, and wherein the region of abrasive material is sandwiched between the first support plate and the second support plate.

21. The abrasive grinding wheel of claim 20 wherein the region of abrasive material comprises a single laminated block.

22. An abrasive grinding wheel that can be rotated about an axis of rotation, comprising:

a means for defining an axis of rotation of said abrasive grinding wheel;

a first support plate;

a second support plate; and a substantially cylindrical region of abrasive material sandwiched between the upper support plate and the lower support plate and formed from a plurality of discrete abrasive segments, each of the plurality of abrasive segments having a plurality of layers of abrasive particles separated from an adjacent layer of abrasive particles by a layer of bond material, and each layer of abrasive particles extending along at least a portion of the circumference of an abrasive surface;

wherein at least one of the plurality of layers of abrasive particles in at least one of the plurality of abrasive segments are offset in a direction of the axis of rotation from at least one of the plurality of layers of abrasive particles in at least one other of the plurality of abrasive segments.

23. The abrasive grinding wheel of claim 22 wherein each of the plurality of layers of abrasive particles in each of the plurality of abrasive segments is oriented to extend substantially perpendicular to the axis of rotation of the abrasive grinding wheel.

24. The abrasive grinding wheel of claim 22 further including:

at least one opening provided in the abrasive surface of the grinding wheel;

a first channel positioned radially interior to the plurality of abrasive segments and in fluid communication with the opening;

a second channel opening to the interior of the abrasive grinding wheel and located in a center region thereof; and at least one radial channel extending from the second channel of the abrasive grinding wheel to the first channel and in fluid communication with the first channel and the second channel;

so that a liquid lubricant provided under pressure to the first channel can pass through the radial channel, into the second channel and through the opening to lubricate the abrasive surface during rotation of the grinding wheel.

25. The abrasive grinding wheel of claim 22 wherein an abrasive segment that extends over a circumferential portion of the abrasive surface is made up of plural axial segments that are stacked adjacent to one another in the axial direction of the grinding wheel and supplied between the first and second support plates.

26. An abrasive grinding wheel that can be rotated about an axis of rotation, the abrasive grinding wheel comprising:

a means for defining an axis of rotation of the abrasive grinding wheel;

a substantially cylindrical region of metal bond abrasive material having a circumferentially extending abrasive surface; and at least one support plate;

wherein the region of metal bond abrasive material is bonded to the support plate with an adhesive.

27. The abrasive grinding wheel of claim 26 wherein the region of abrasive material is formed from a plurality of discrete abrasive segments which are circumferentially spaced at the periphery of the grinding wheel to provide the circumferentially extending abrasive surface.

28. The abrasive grinding wheel of claim 26 including a first and a second support plate the first and second plates forming the outer axial surface of the grinding wheel wherein the region of abrasive material is interposed between the first support plate and the second support plate and wherein the region of abrasive material is bonded to the first and the second support plate by an adhesive.

29. The abrasive grinding wheel of claim 26 wherein the adhesive is a thermosetting adhesive.

30. The abrasive grinding wheel of claim 26 wherein the adhesive has a shear strength of at least about 1000 psi.

31. The abrasive grinding wheel of claim 26 wherein the adhesive has a shear strength of at least about 1500 psi.

32. The abrasive grinding wheel of claim 26 wherein the abrasive particles are selected from the group consisting of diamond, cubic boron nitride, boron suboxide, and combinations thereof.

33. The abrasive grinding wheel of claim 26 wherein the metal bond abrasive material comprises a plurality of abrasive particles randomly distributed in a metal bond material.

34. The abrasive grinding wheel of claim 26 wherein the metal bond abrasive material comprises a plurality of abrasive particles which are present in substantially planar, parallel layers.

35. The abrasive grinding wheel of claim 26 wherein the support plate is made of steel, aluminum, brass, titanium, polymer, fiber reinforced polymer, or a combination thereof.

36. An abrasive grinding wheel that can be rotated about an axis of rotation, comprising:

a means for defining an axis of rotation of the abrasive grinding wheel;

a first support plate;

a second support plate;

a substantially cylindrical region of metal bond abrasive material formed from a plurality of discrete abrasive segments interposed between the first support plate and the second support plate and bonded to the first and the second support plate with an adhesive.

* * * * *

UNITED STATES PATENT AND TRADEMARK OFFICE

CERTIFICATE OF CORRECTION

PATENT NO. : 6,358,133 B1
DATED : March 19, 2002
INVENTOR(S) : Cesena, Robert T.

It is certified that error appears in the above-identified patent and that said Letters Patent is hereby corrected as shown below:

Title page,
Item [56], insert -- OTHER DOCUMENTS (Including Authors, Title, Date, Pertinent Papers, etc.) Structural Adhesive Film AF-30, (5, 10 and 12 mil) brochure, 11 pages, March 1, 1996 --.

Column 5,
Line 6, delete "though" and insert in place thereof -- through --.

Column 11,
Line 36, insert -- . -- following "thereof".

Signed and Sealed this

Eighteenth Day of November, 2003

JAMES E. ROGAN
*Director of the United States Patent and Trademark Office*